US005367230A

United States Patent [19]

Iguchi et al.

[11] Patent Number: 5,367,230

[45] Date of Patent: Nov. 22, 1994

[54] CATHODE-RAY TUBE WITH CONVERGENCE YOKE LENS SYSTEMS

[75] Inventors: Yukinobu Iguchi; Koji Hasegawa, both of Kanagawa, Japan

[73] Assignee: Sony Corporation, Tokyo, Japan

[21] Appl. No.: 974,714

[22] Filed: Nov. 12, 1992

[30] Foreign Application Priority Data

Nov. 14, 1991 [JP] Japan ..... 3-299203

[51] Int. Cl.[5] ..... H01J 29/46; H01J 29/56; H01J 29/51

[52] U.S. Cl. ..... 315/368.15; 313/414

[58] Field of Search ..... 315/382, 382.1, 368.15, 315/368.16, 15; 313/412, 414, 449

[56] References Cited

U.S. PATENT DOCUMENTS 4,877,998 10/1989 Maninger et al. ..... 315/15
5,025,189 6/1991 Son ..... 313/414
5,061,881 10/1991 Suzuki et al. ..... 315/382

FOREIGN PATENT DOCUMENTS 0235975 9/1987 European Pat. Off. ..... H01J 29/50
0265683 5/1988 European Pat. Off. ..... H01J 29/56
2095895 10/1982 United Kingdom ..... H01J 37/153

*Primary Examiner*—Theodore M. Blum
*Attorney, Agent, or Firm*—Lewis H. Eslinger; Jay H. Maioli

[57] ABSTRACT

A cathode-ray tube has an electron gun disposed in its neck in confronting relationship to a phosphor screen through a deflection yoke mounted on the funnel. The electron gun has a cathode assembly for emitting three electron beams, and a main lens for passing the electron beams therethrough. The main lens includes a quadruple lens system responsive to focusing voltages for canceling an astigmatic effect produced on the electron beams when the electron beams are deflected by the deflection yoke, at a peripheral edge of the phosphor screen. The cathode-ray tube also has a first quadruple convergence yoke lens system disposed between the main lens and the deflection yoke for generating an astigmatic effect which is opposite to the deflection-induced astigmatic effect, and a second quadruple convergence yoke lens system disposed between the emitting means and the main lens means for generating an astigmatic effect which is in the same direction as the astigmatic effect generated by the first quadruple convergence yoke lens system.

5 Claims, 18 Drawing Sheets (X-Axis End of Screen)

(Screen Center)

(V)

(X-Axis End of Screen)

(Screen Center)

CATHODE-RAY TUBE WITH CONVERGENCE YOKE LENS SYSTEMS

BACKGROUND OF THE INVENTION

1. Field of the Invention

The present invention relates to a cathode-ray tube, and more particularly to an electron gun for use in a cathode-ray tube.

2. Description of the Prior Art

Recently available color picture tubes employ deflection yokes of the self-convergence type.

As shown in FIG. 1 off the accompanying drawings, such a self-convergence deflection yoke produces a horizontal deflecting magnetic field with pin-cushion distortion and a vertical deflecting magnetic field with barrel distortion for deflecting and automatically converging three R, G, B electron beams on a phosphor screen.

Since, however, the horizontal and vertical deflecting magnetic fields are distorted in the shapes of a pin-cushion and a barrel, respectively, the spot which is produced by the electron beams on the phosphor screen tends to be defocused or distorted at outer edges of the screen, as shown in FIG. 2 of the accompanying drawings. The electron beam spot is distorted because each of the electron beams, which has a certain finite spatial extent, is subjected to different forces in different locations on the phosphor screen.

The electron beam spot distortion, at an end of the X-axis of the phosphor screen, in the horizontal deflecting magnetic field, which is distorted in a pin-cushion pattern, will be described in greater detail with reference to FIG. 3 of the accompanying drawings. In FIG. 3, an electron beam e passes through the plane defined by FIG. 3 in a direction away from the viewer, and four 90°-spaced points A, B, C, D are assumed to be on the peripheral edge of a cross-sectional plane through the electron beam e. Since the magnetic field is stronger at the point B than at the point A, the electron beam e undergoes lateral forces on its opposite sides. At the same time, forces directed toward the center of the electron beam e are applied to the points C and D.

Therefore, the electron beam spot on the phosphor screen is slightly underfocused, i.e., it would come to a focus beyond the phosphor screen, in the horizontal direction, and is strongly overfocused, i.e., it would come to a focus short of the phosphor screen, and hence diverges to produce a halo, in the vertical direction. FIGS. 4A and 4B of the accompanying drawings schematically show, using an optical lens system simulating the electron gun, how the electron beam is focused at the center and the X-axis end, respectively, of the phosphor screen. The optical lens system includes a main lens 31 and a deflection yoke 32. In FIGS. 4A and 4B, the electron beam is emitted from an object point a on a cathode, and is focused at a focus point f. The vertical lens effect of the optical lens system is shown on the upper side of the Z-axis, and the horizontal lens effect of the optical lens system is shown on the lower side of the Z-axis. The above horizontally underfocused and vertically overfocused condition of the electron beam spot is illustrated in FIG. 4B.

The relationship between the size of the electron beam spot and the focusing voltage applied to the deflection yoke is shown in FIGS. 5A and 5B of the accompanying drawings.

At the center of the phosphor screen, as shown in FIG. 5A, focusing voltages Vfv and Vfh applied to bring the electron beam spot into focus vertically and horizontally are equal to each other. The minimum sizes of the electron beam spots in the vertical and horizontal directions are the same as each other. Therefore, the electron beam spot is substantially circular in shape at the center of the phosphor screen.

At the X-axis end, however, the focusing voltage Vfv applied to focus the electron beam spot vertically is higher than the focusing voltage Vfh applied to focus the electron beam spot horizontally by $\Delta$Vfo (about 1.3 kv in FIG. 5B). Furthermore, the minimum sizes of the electron beam spots in the vertical and horizontal directions are different from each other; the horizontal minimum size of the electron beam spot is about 2.5 times greater than the vertical minimum size of the electron beam spot. The voltage difference $\Delta$Vfo is referred to as an astigmatic difference. The corrective voltage applied in a system which employs a dynamic quadruple structure and a dynamic focusing action (described hereinafter) is proportional to the astigmatic difference $\Delta$Vfo.

Since the electron beam spot comes to the focus f short of the phosphor screen in the vertical direction as described above, a halo is generated above and below the electron beam spot at the peripheral region of the phosphor screen, as shown in FIGS. 2 and 4B. As a result, the electron beam spot is distorted due to astigmatism at the peripheral region of the phosphor screen.

Cathode-ray tubes with non-self-convergence deflection yokes usually have a quadruple convergence yoke disposed behind the deflection yoke. The quadruple convergence yoke is supplied with a predetermined current in synchronism with the deflection of the electron beam by the deflection yoke. Usually, the electron beam spot in such cathode-ray tubes is also distorted at the peripheral region of the phosphor screen in the same fashion as with the self-convergence deflection yokes.

One solution to the above problem, employed particularly for low-cost cathode-ray tube models, is to make a portion of the electron gun rotationally asymmetrical to produce an astigmatic effect on the electron beam which is opposite to the astigmatism due to the deflection magnetic field for thereby improving the electron beam spot at the peripheral region of the phosphor screen. Inasmuch as the generated reversal astigmatic effect is fixed, the electron beam spot is necessarily brought out of focus at the center of the phosphor screen.

On the other hand, expensive cathode-ray tube models have an electromagnetic or electrostatic quadruple element near the main lens of the electron gun. The intensity of the converging effect of the quadruple element and the intensity of the focusing effect of the main lens are varied in synchronism with the deflecting action for producing a well-focused electron beam spot on the phosphor screen. Such a system is based on a combination of a dynamic quadruple structure and a dynamic focusing action. More specifically, the intensity of the converging effect of the dynamic quadruple element and the intensity of the focusing effect of the main lens are dynamically adjusted by a circuit arrangement to improve the focus of the electron beam spot at the peripheral region of the phosphor screen while maintaining the electron beam spot in focus at the screen center.

Actually, the above system is supplied with an AC voltage whose waveform is of a quasi-parabolic shape for improving the focus of the electron beam at the peripheral region of the phosphor screen. Since the astigmatic difference ΔVfo is large, as described above, it is customary to add an AC voltage of about 1 kv to the focusing voltage, which is normally in the range of from 5 to 10 kv. Because of the high voltage requirement, the required circuit arrangement suffers a relatively large burden.

Recently developed cathode-ray tubes for use in EDTV receivers, HDTV receivers, and computer display units employ higher deflection frequencies. As the corrective voltage is high, it is difficult to generate the voltage with a suitable waveform in view of the higher deflection frequencies without a complex circuit design and a high circuit cost.

OBJECTS AND SUMMARY OF THE INVENTION

It is therefore an object of the present invention to provide a cathode-ray tube which can reduce an astigmatic difference or the difference between focusing voltages in vertical and horizontal directions at the peripheral region of the screen without inducing any substantial change in the shape of an electronic beam spot on the screen, for thereby reducing a dynamic corrective quantity and any burden imposed on a circuit arrangement.

According to the present invention, there is provided a cathode-ray tube comprising a phosphor screen, a deflection yoke, and an electron gun disposed in confronting relationship to the phosphor screen through the deflection yoke, the electron gun comprising emitting means for emitting three electron beams, main lens means for passing the electron beams therethrough, the main lens means including a quadruple lens system responsive to focusing voltages for canceling an astigmatic effect produced on the electron beams at a peripheral region of the phosphor screen when the electron beams are deflected by the deflection yoke, a first quadruple convergence yoke lens system disposed between the main lens means and the deflection yoke for generating an astigmatic effect which is opposite to the astigmatic effect which is produced on the electron beams when the electron beams are deflected, and a second quadruple convergence yoke lens system disposed between the emitting means and the main lens means for generating an astigmatic effect which is in the same direction as the astigmatic effect generated by the first quadruple convergence yoke lens system.

Each of the first and second quadruple convergence yoke lens systems comprises a concave lens in a direction normal to and a convex lens in a direction parallel to a direction in which the electron beams are deflected by the deflection yoke.

The quadruple lens system of the main lens means comprises a convex lens in a first direction normal to and a convex lens in a second direction parallel to a direction in which the electron beams are deflected by the deflection yoke, each of the convex lenses having a stronger lens power intensity in the first direction and a weaker lens power intensity in the second direction.

The second quadruple convergence yoke lens system comprises an electrode lying substantially perpendicularly to an axis of the cathode-ray tube, the electrode having an array of successive beam passage holes defined therein for passing the electron beams respectively therethrough.

The first quadruple convergence yoke lens system may comprise first, second, and third flat electrodes lying substantially perpendicularly to an axis of the cathode-ray tube, the first electrode being positioned closer to the main lens means, the third electrode being positioned closer to the phosphor screen, each of the first and third electrodes having an elongate rectangular beam passage hole defined therein for passing the electron beams therethrough, and the second electrode being positioned between the first and third electrodes and having three separate elongate rectangular beam passage holes defined therein for passing the electron beams respectively therethrough.

The first quadruple convergence yoke lens system may comprise a convergence cup having an array of three separate beam passage holes defined therein for passing the electron beams respectively therethrough, and three pairs of sheet-like magnets, the sheet-like magnets in each pair being disposed on opposite edges of one of the beam passage holes.

The first quadruple convergence yoke lens system may comprise a plurality of side walls defining electron beam passages therebetween for passing the electron beams respectively therethrough, and a plurality of sheet-like magnets mounted on the side walls, respectively.

The first quadruple convergence yoke lens system, which generates an astigmatic effect on the electron beam which is opposite to the astigmatism due to the deflection magnetic field produced by the deflection yoke, is disposed between the main lens means and the deflection yoke for making the ratio of the vertical and horizontal image magnifications greater than 1, thus reducing the difference (astigmatic difference) between dynamic focusing voltages applied to the main lens means.

The second quadruple convergence yoke lens system, which produces an astigmatic effect in the same direction as the astigmatic effect produced by the first quadruple convergence yoke lens system, is disposed between the emitting means and the main lens means. While the difference between the dynamic focusing voltages applied to the main lens means remains reduced, the second quadruple convergence yoke lens system is effective to cause the magnification ratio to approach 1, thereby applying a substantially circular electron beam spot to the center of the phosphor screen.

Accordingly, the cathode-ray tube according to the present invention can reduce the astigmatic difference or the difference between the focusing voltages between the dynamic vertical and horizontal directions, at the peripheral regions of the phosphor screen, without varying the shape of the electron beam spot at the center of the phosphor screen. Therefore, the dynamic corrective quantity can be reduced, and any burden on the circuit arrangement used to generate and apply the corrective voltages can also be reduced.

The above and other objects, features, and advantages of the present invention will become apparent from the following description of illustrative embodiments thereof to be read in conjunction with the accompanying drawings, in which like reference numerals represent the same or similar objects.

DETAILED DESCRIPTION OF THE PREFERRED EMBODIMENTS

Figure 6A:
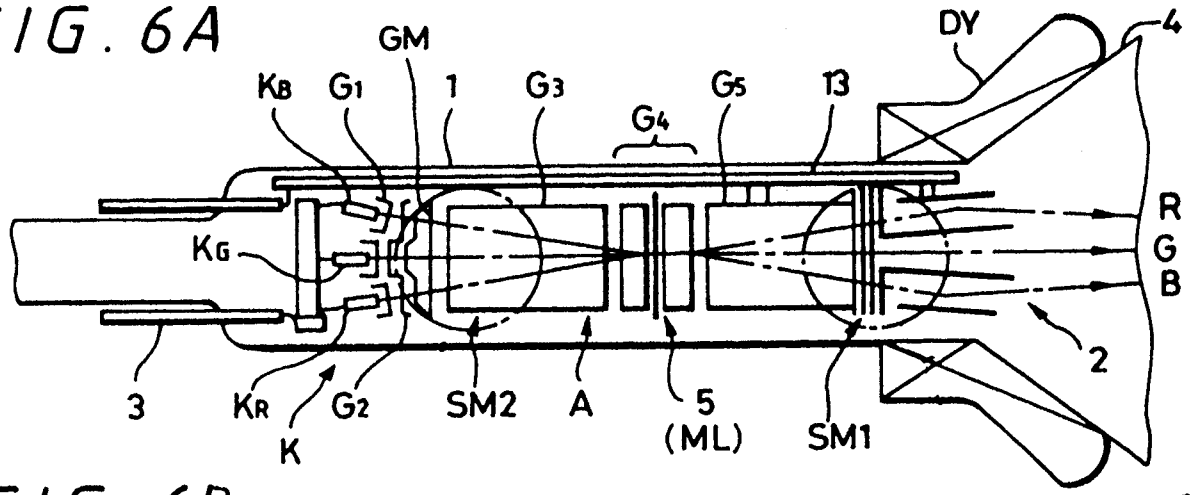
FIG. 6A–6C are fragmentary horizontal cross-sectional views of a cathode-ray tube, as viewed from above, according to the present invention.

As shown in FIG. 6A, a cathode-ray tube according to the present invention has an electron gun A sealed in a neck 1, which is made of glass, for example. The electron gun A comprises a cathode assembly K composed of cathodes $K_R$, $K_G$, $K_B$ for generating respective electron beams R, G, B, and an electronic lens system composed of a first grid $G_1$, a second grid $G_2$, an auxiliary electrode $G_M$, a third grid $G_3$, a fourth grid $G_4$, a fifth grid $G_5$, and an assembly of electrostatic deflection plates 2. The electrostatic deflection plates 2 serve to converge the three electron beams R, G, B as one spot on the phosphor screen of the cathode-ray tube.

The cathode assembly K is positioned in a rear end portion of the neck 1 and has terminals 3 projecting rearwardly from the rear end of the neck 1. The first grid $G_1$, the second grid $G_2$, the auxiliary electrode $G_M$, the third grid $G_3$, the fourth grid $G_4$, the fifth grid $G_5$, and the electrostatic deflection plates 2 are successively arranged in the neck 1 in the order named from the cathode assembly K toward the phosphor screen of the cathode-ray tube.

The cathode-ray tube includes a funnel 4 extending from the neck 1 toward the phosphor screen. A deflection yoke DY for generating deflection magnetic fields is mounted on the neck 1 and the funnel 4 across the junction therebetween. The third grid $G_3$, the fourth grid $G_4$, and the fifth grid $G_5$ jointly provide a main lens ML positioned at the fourth grid $G_4$. The region where the main lens ML is located is referred to as a main lens region 5.

Figure 7:
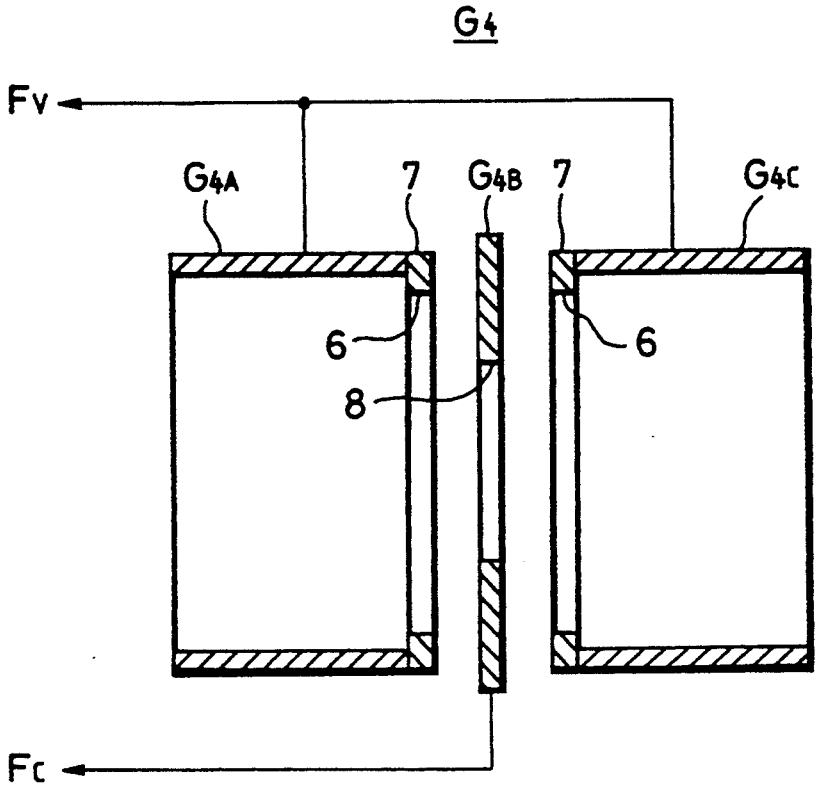
FIG. 7 is a cross-sectional view of a fourth grid, as viewed from above, in the cathode-ray tube shown in FIG. 6A.

The fourth grid $G_4$ is of a known built-in quadruple convergent yoke structure. More specifically, as shown in FIG. 7, the fourth grid $G_4$ comprises first, second, and third electrodes $G_{4A}$, $G_{4B}$, $G_{4C}$. The first and third electrodes $G_{4A}$, $G_{4C}$, which are positioned one on each side of the second electrode $G_{4B}$, are cylindrical in shape, and the second electrode $G_{4B}$ is of a flat disc shape (see also FIG. 8C).

Figure 8A:
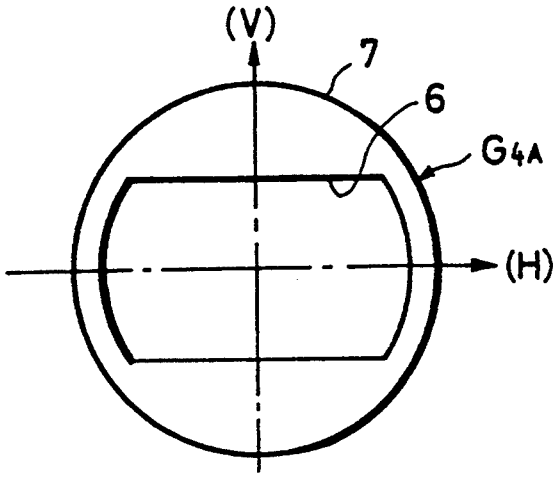
FIG. 8A is a front elevational view of a first electrode, as viewed from the phosphor screen, of the fourth grid shown in FIG. 7.
Figure 8B:
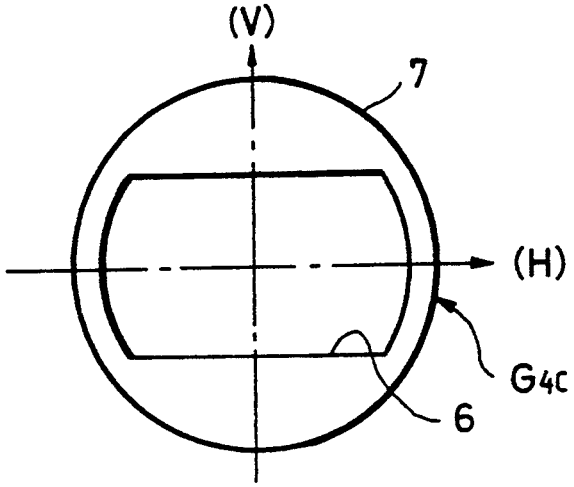
FIG. 8B is a front elevational view of a second electrode, as viewed from the phosphor screen, of the fourth grid shown in FIG. 7.
Figure 8C:
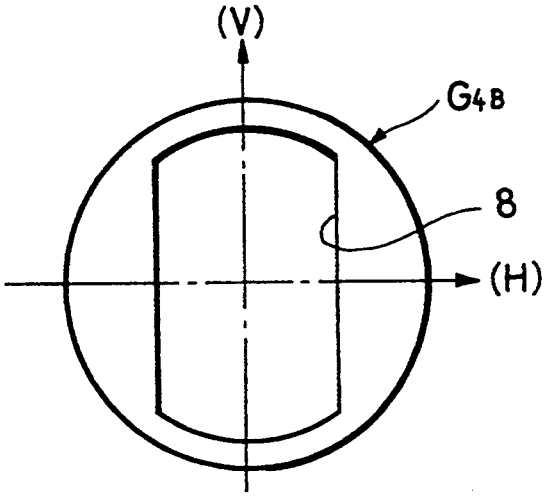
FIG. 8C is a front elevational view of a third electrode, as viewed from the cathode, of the fourth grid shown in FIG. 7.
Figure 9:
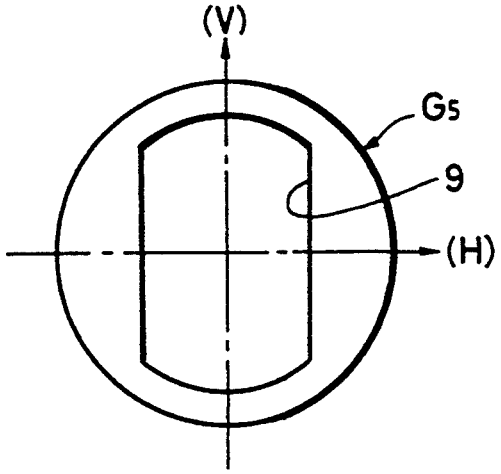
FIG. 9 is a front elevational view of a fifth grid, as viewed from the cathode, in the cathode-ray tube shown in FIG. 6A.

As also shown in FIGS. 8A and 8B, flat discs 7 with horizontally elongate beam passage holes 6 defined therein are welded or otherwise fixed to respective confronting ends of the first and third electrodes $G_{4A}$, $G_{4C}$. As shown in FIG. 8C, the second electrode $G_{4B}$ has a vertically elongate beam passage hole 8 defined therein. As shown in FIG. 9, the fifth grid $G_5$ has a vertically elongate beam passage hole 9 defined in an end thereof which faces the fourth grid $G_4$.

In operation, a fixed voltage Fc is applied to the second electrode $G_{4B}$, and a focusing voltage Fv is applied to the first and third electrodes $G_{4A}$, $G_{4C}$ in synchronism with the cyclic period of a deflection voltage applied to the deflection plates 2, for producing an electrostatic quadruple convergence yoke in the main lens region 5. The focusing voltage Fv is corrected to adjust the intensity of the converging effect of the electrostatic quadruple convergence yoke and also the intensity of the focusing effect of the main lens ML for improving the focus of electron beam spots at the peripheral regions of the phosphor screen while maintaining the electron beam spots in focus at the screen center.

Figure 1:
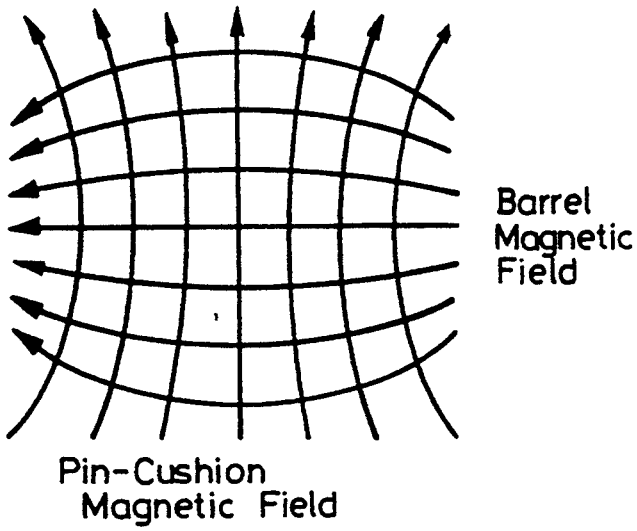
FIG. 1 (PRIOR ART)
FIG. 1 is a diagram showing deflection magnetic fields produced by a deflection yoke of a conventional cathode-ray tube.
Figure 2:
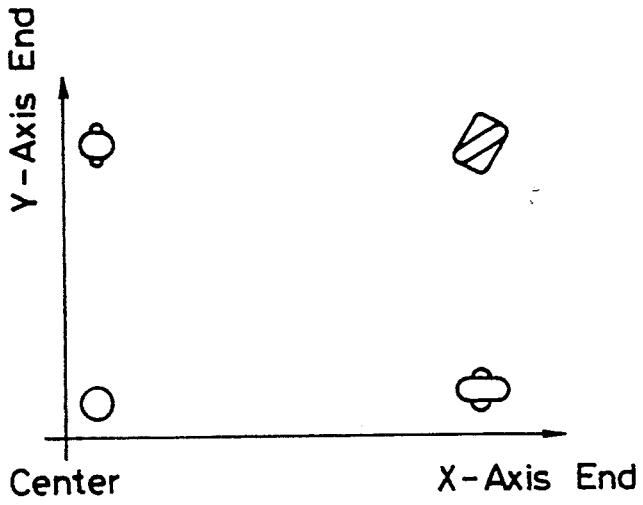
FIG. 2 (PRIOR ART)
FIG. 2 is a diagram showing distortions of electron beam spots in the conventional cathode-ray tube.
Figure 3:
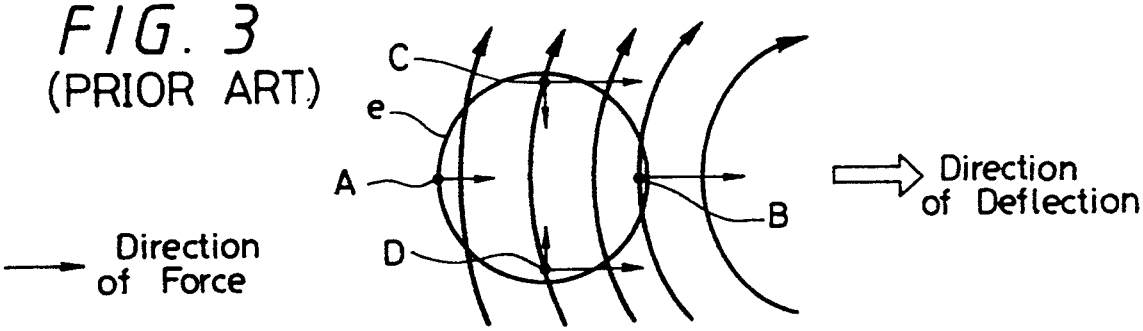
FIG. 3 (PRIOR ART)
FIG. 3 is a diagram showing forces acting on an electron beam at an X-axis end of the phosphor screen of the conventional cathode-ray tube.
Figure 4A:
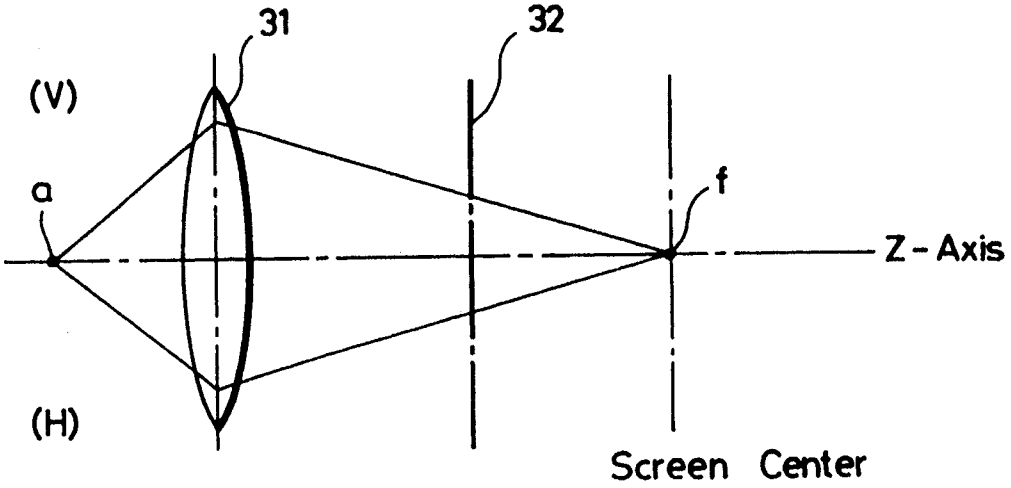
FIG. 4A (PRIOR ART)
FIGS. 4A and 4B are diagrams showing lens effects of the deflection yoke at the center and the X-axis end, respectively, of the phosphor screen of the conventional cathode-ray tube.
Figure 4B:
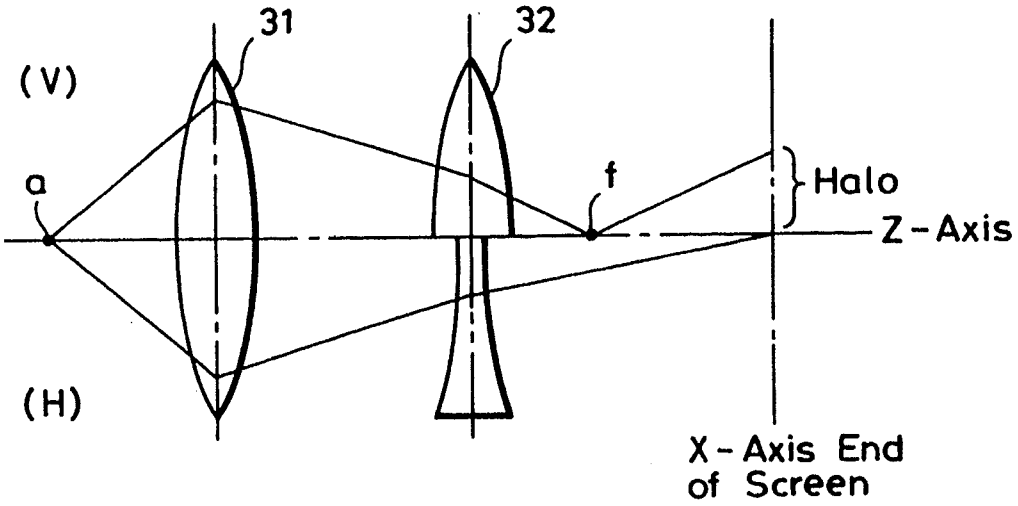
FIG. 4B (PRIOR ART)
Figure 5B:
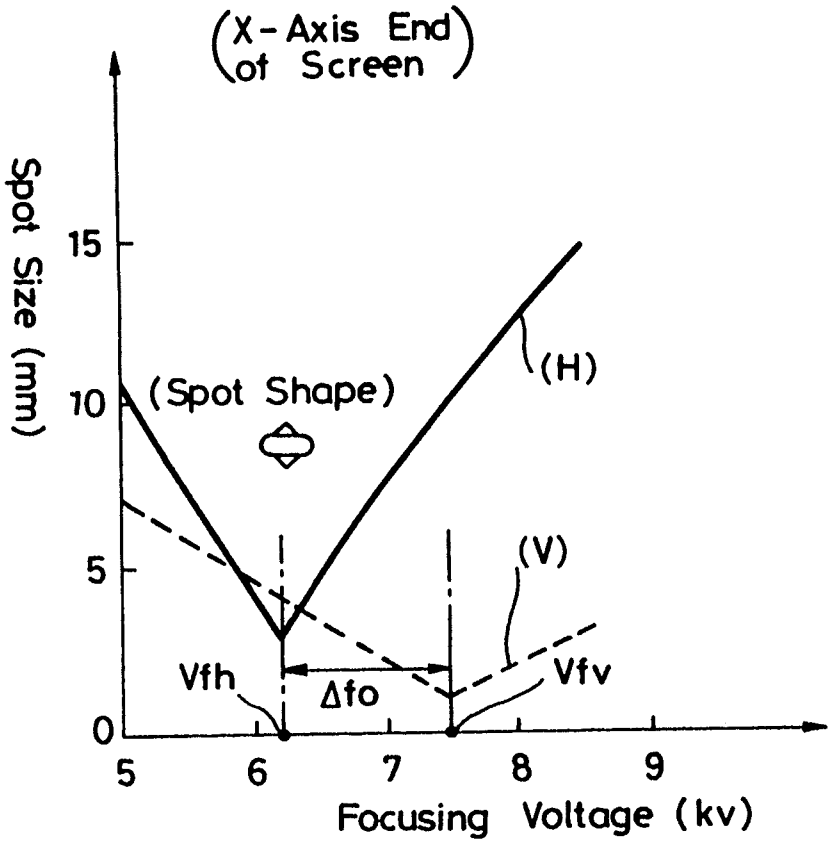
FIG. 5B (PRIOR ART)
FIGS. 5A and 5B are diagrams showing the relationship between spot sizes and focusing voltages at the center and the X-axis end, respectively, of the phosphor screen of the conventional cathode-ray tube.
Figure 5A:
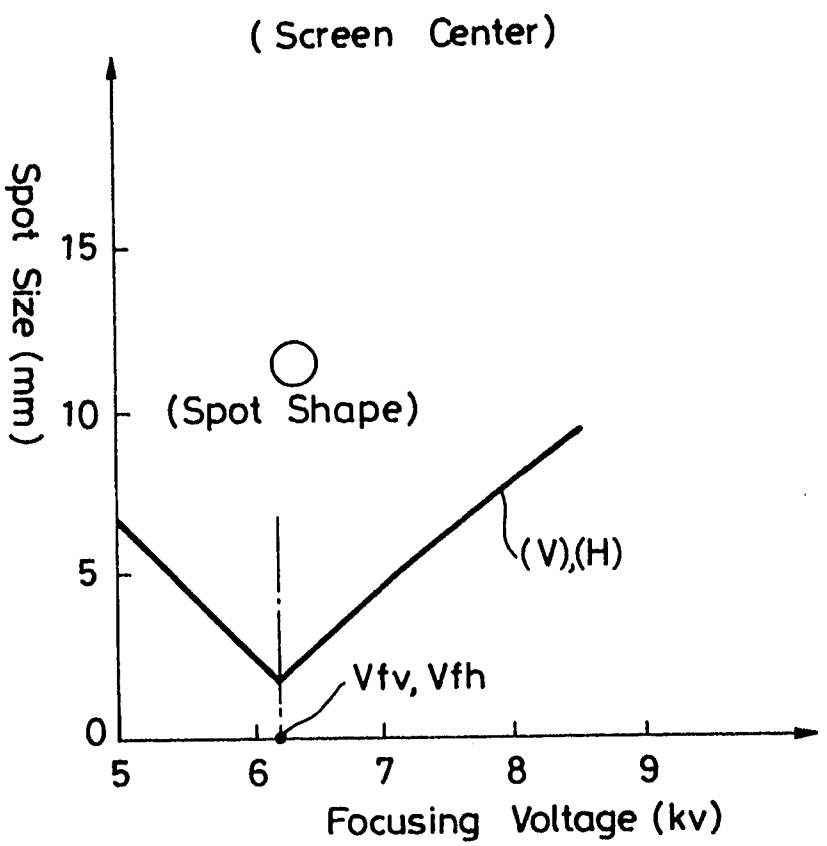
FIG. 5A (PRIOR ART)

Actually, as described above with reference to FIG. 5B, inasmuch as the astigmatic difference $\Delta Vfo$ is large, it is necessary to add an AC voltage of about 1 kv to the focusing voltage, which is normally in the range of from 5 to 10 kv. The high voltage requirement puts a relatively large burden on the required circuit arrangement.

According to the present invention, as shown in FIG. 6, a first quadruple convergence yoke lens system SM1 for generating an astigmatic effect on the electron beams which is opposite to the astigmatic effect of the built-in quadruple convergent yoke structure in the main lens region 5 is disposed between the fifth grid $G_5$ and the electrostatic deflection plates 2, i.e., the deflection yoke DY. Furthermore, a second quadruple convergence yoke lens system SM2 for generating a similar astigmatic effect on the electron beams which is also opposite to the astigmatic effect of the built-in quadruple convergent yoke structure in the main lens region 5 is disposed between the cathode assembly K and the main lens region 5.

Figure 6B:
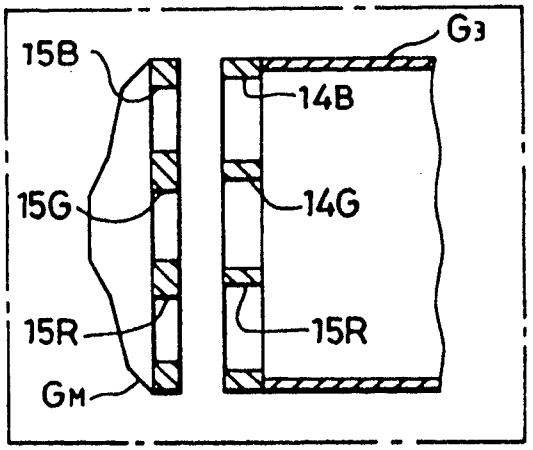
Figure 10A:
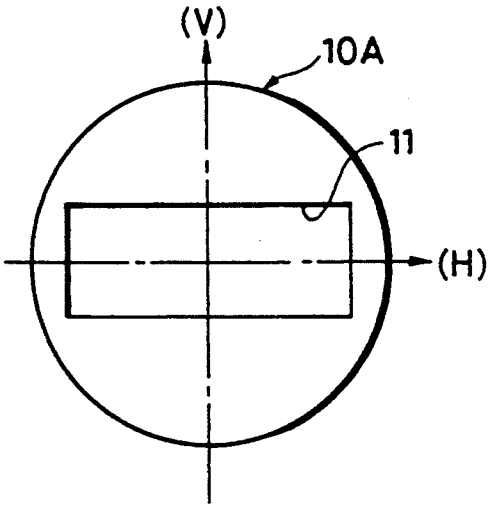
FIG. 10A is a front elevational view of a first electrode, as viewed from the phosphor screen, of a first quadruple convergence yoke lens system in the cathode-ray tube shown in FIG. 6B.
Figure 10B:
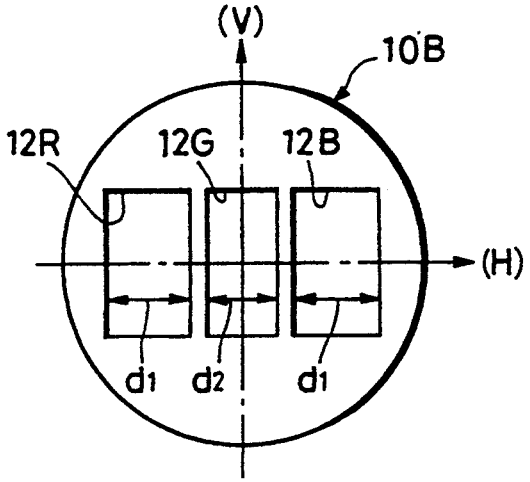
FIG. 10B is a front elevational view of a second electrode, as viewed from the phosphor screen, of the first quadruple convergence yoke lens system.
Figure 10C:
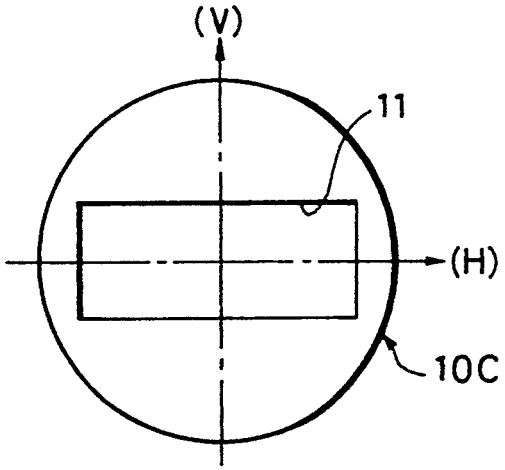
FIG. 10C is a front elevational view of a third electrode, as viewed from the phosphor screen, of the first quadruple convergence yoke lens system.

As shown in cross section at enlarged scale in FIG. 6B, the first quadruple convergence yoke lens system SM1 comprises first, second, and third flat electrodes 10A, 10B, 10C lying perpendicularly to the axis of the cathode-ray tube and positioned between the fifth grid $G_5$ and the electrostatic deflection plates 2. As shown in FIGS. 10A through 10C, the electrodes 10A, 10B, 10C comprise metallic flat discs, respectively. The first and third electrodes 10A, 10C, which are positioned one on each side of the second electrode 10B, have horizontally elongate rectangular beam passage holes 11 defined respectively therein having horizontally longer axes. The second electrode 10B has three separate beam passage holes 12R, 12G, 12B defined therein for passage therethrough of the electron beams R, G, B emitted from the cathode assembly K.

The beam passage holes 12R, 12G, 12B are successively arranged in the horizontal direction. Each of the beam passage holes 12R, 12G, 12B is of a vertically elongate rectangular shape having a vertical longer axis. The beam passage holes 12R, 12B have a horizontal width $d_1$ slightly greater than the horizontal width $d_2$ of the central beam passage hole 12G. The first, second, and third flat electrodes 10A, 10B, 10C with the respective beam passage holes 12R, 12G, 12B jointly provide a quadruple convergence yoke lens for vertically diverging the electron beams and horizontally converging the electron beams.

As shown at enlarged scale in FIG. 6B, a high anode voltage Hv, which is also applied to the fifth grid $G_5$, is applied to the first and third electrodes 10A, 10C, and a relatively low convergence voltage Hc, which is also applied to the electrostatic deflection plates 2, is applied to the second electrode 10B. These anode and convergence voltages Hv, Hc are supplied from a resistor 13 which is also sealed in the neck 1.

Figure 6C:
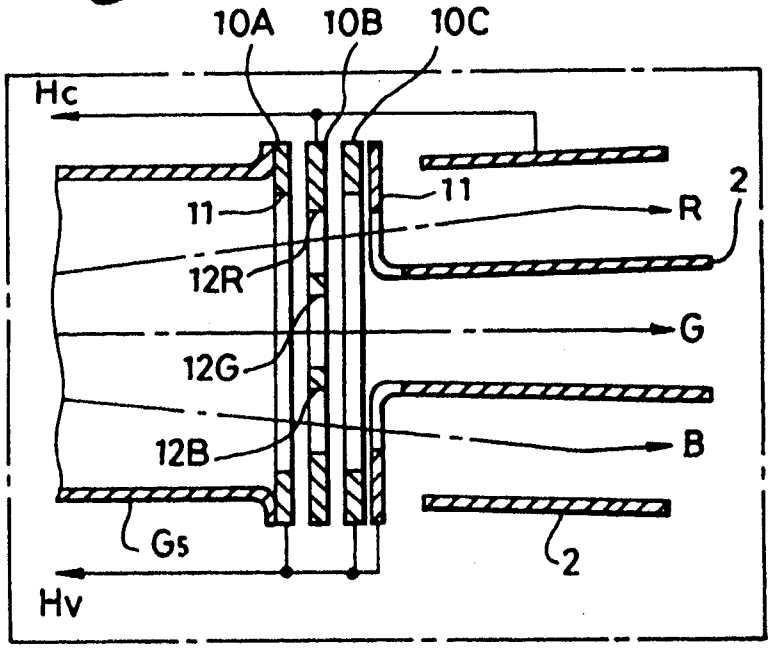
Figure 11A:
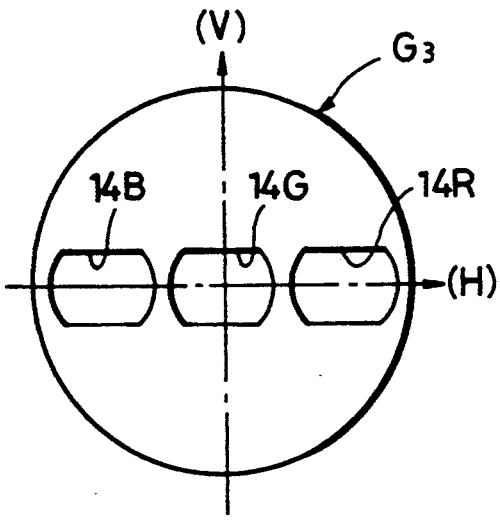
FIG. 11A is a front elevational view of a third grid, as viewed from the cathode, of a second quadruple convergence yoke lens system in the cathode-ray tube shown in FIG. 6C.
Figure 11B:
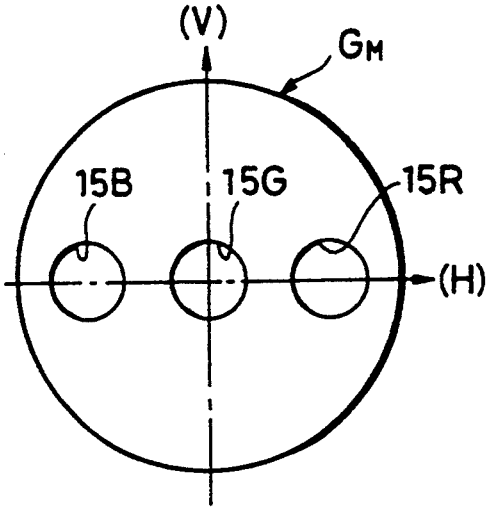
FIG. 11B is a front elevational view of an auxiliary electrode, as viewed from the phosphor screen, of the second quadruple convergence yoke lens system in the cathode-ray tube shown in FIG. 6C.

As also shown in cross section at enlarged scale in FIG. 6C, the second quadruple convergence yoke lens system SM2 has three separate beam passage holes 14R, 14G, 14B defined in the end of the third grid $G_3$ facing the cathode assembly K for passage therethrough of the electron beams R, G, B emitted from the cathode assembly K. As shown in FIG. 11A, the beam passage holes 14R, 14G, 14B are successively arranged in the horizontal direction. Each of the beam passage holes 14R, 14G, 14B is of a horizontally elongate rectangular shape having a horizontal longer axis. The second quadruple convergence yoke lens system SM2 also includes the auxiliary electrode $G_M$, which is of a known structure for improving the combined aberration of a prefocusing lens and the main lens ML, positioned between the second grid $G_2$ and the third grid $G_3$. The auxiliary electrode $G_M$ has three separate beam passage holes 15R, 15G, 15B defined therein for passage therethrough of the electron beams R, G, B emitted from the cathode assembly K. As shown in FIG. 11B, the beam passage holes 15R, 15G, 15B are successively arranged in the horizontal direction. Each of the beam passage holes 15R, 15G, 15B is of a circular shape. The grid $G_3$ with the beam passage holes 14R, 14G, 14B and the auxiliary electrode $G^M$ with the beam passage holes 15R, 15G, 15B jointly provide a quadruple convergence yoke lens for vertically diverging the electron beams and horizontally converging the electron beams.

Figure 12A:
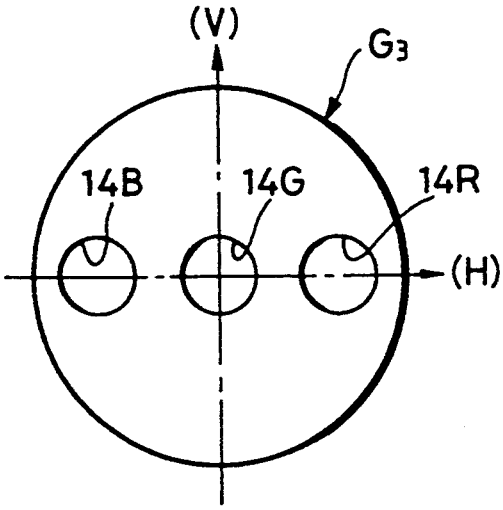
FIG. 12A is a front elevational view of a third grid, as viewed from the cathode, of a second quadruple convergence yoke lens system according to another embodiment.
Figure 12B:
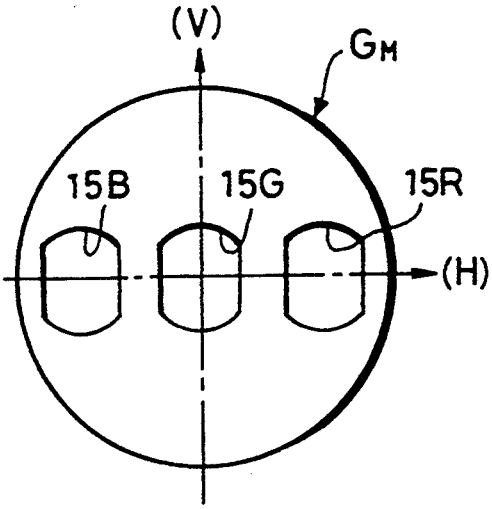
FIG. 12B is a front elevational view of an auxiliary electrode, as viewed from the phosphor screen, of the second quadruple convergence yoke lens system according to the other embodiment.

As shown in FIGS. 12A and 12B, the third grid $G_3$ may have circular beam passage holes 14R, 14G, 14B, and the auxiliary electrode $G_M$ may have vertically elongate rectangular beam passage holes 15R, 15G, 15B.

Figure 13:
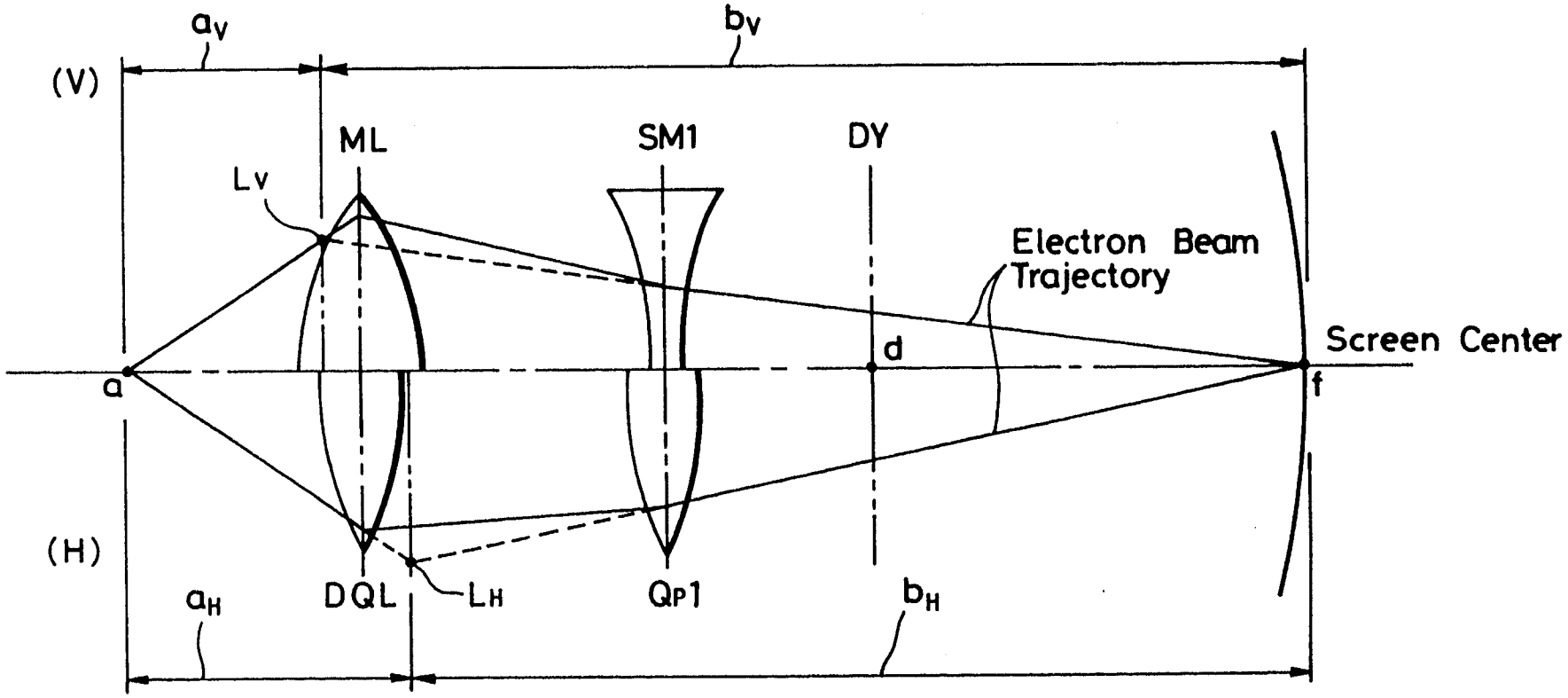
FIG. 13 is a diagram showing a lens effect of the first quadruple convergence yoke lens system.

A lens effect of the first quadruple convergence yoke lens system SM1 will be described below using an optical lens system which simulates the electron gun. As shown in FIG. 13, the main lens ML is shown as a combination of convex lenses in the vertical and horizontal directions. The convex lens in the vertical direction has a stronger lens effect and the convex lens in the horizontal direction has a weaker leans effect because of the built-in quadruple lens, indicated by DQL, of the fourth grid $G_4$.

The first quadruple convergence yoke lens system SM1 is represented by a combination of a concave lens in the vertical direction and a convex lens in the horizontal direction, which are positioned between the main lens ML and a center d of the magnetic field produced by the deflection yoke DY. These concave and convex lenses jointly provide a quadruple lens Qp1 which diverges the electron beams vertically and converges the electron beams horizontally.

The quadruple lens Qp1 is of fixed astigmatism and has an astigmatic effect that is opposite to the astigmatic effect of the main lens ML. In FIG. 13, the electron beams are emitted from an object point a on the cathode assembly K, and are focused at a focus point f on the phosphor screen. The electron beams travel along trajectories indicated by the solid lines in the vertical and horizontal directions.

Figure 14B:
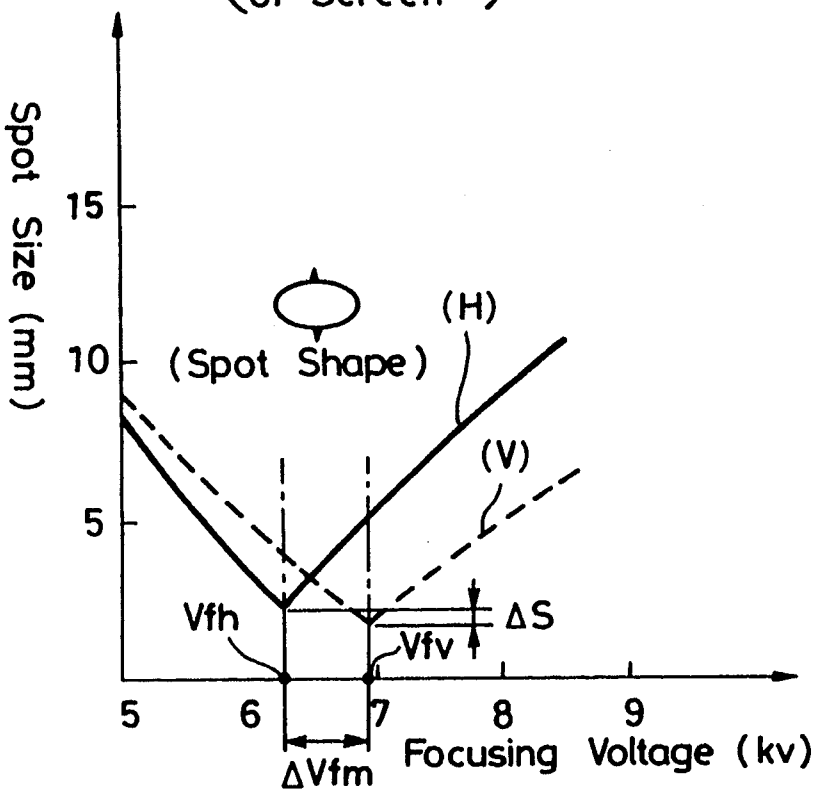
FIGS. 14A and 14B are diagrams showing the relationship between spot sizes and focusing voltages at the center and the X-axis end, respectively, of the phosphor screen, achieved through the action of the first quadruple convergence yoke lens system.
Figure 14A:
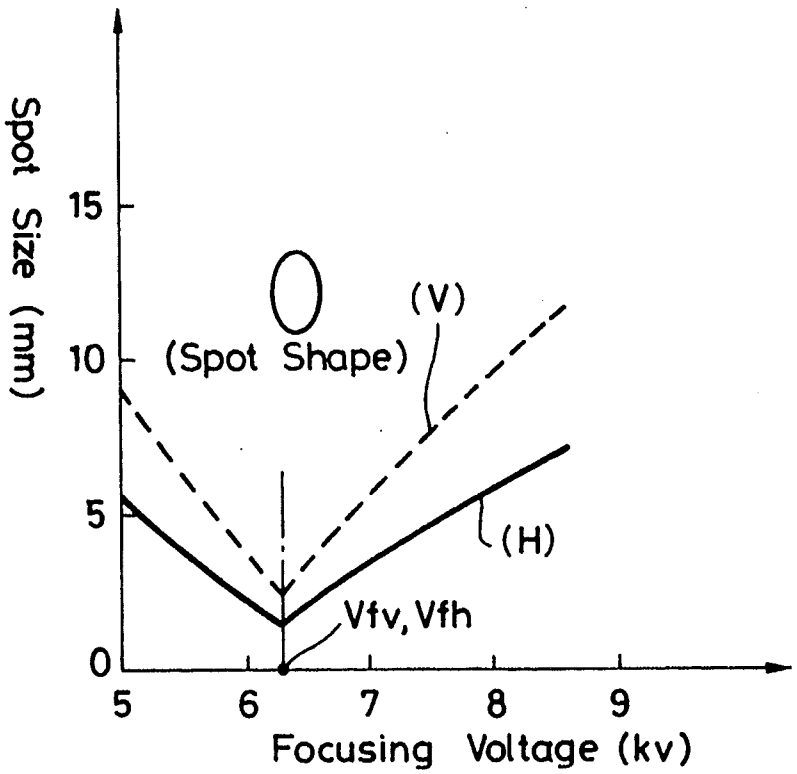

As shown in FIGS. 14A and 14B, focusing voltages Vfv, Vfh applied to bring each of the electron beam spots into focus vertically and horizontally at the center of the phosphor screen are equal to each other. Therefore, the electron beams can be brought into exact focus vertically and horizontally at the center of the phosphor screen by the first quadruple convergence yoke lens system SM1.

At the X-axis end of the phosphor screen, the focusing voltage Vfv applied to focus the electron beam spot vertically is higher than the focusing voltage Vfh applied to focus the electron beam spot horizontally by an astigmatic difference ΔVfm (about 0.7 kv in FIG. 14B). However, the astigmatic difference ΔVfm is much smaller than the conventional astigmatic difference ΔVfo (about 1.3 kv) shown in FIG. 5B. The minimum sizes of the electron beam spot in the vertical and horizontal directions are close to each other, and the difference ΔS between the minimum sizes is very small.

The first quadruple convergence yoke lens system SM1 is therefore effective to reduce the absolute value of the astigmatic difference ΔVfm at the peripheral region of the phosphor screen. With the astigmatic difference ΔVfm reduced, the dynamic corrective voltage proportional to the astigmatic difference ΔVfm, applied in the dynamic quadruple structure and the dynamic focusing action, is also reduced.

Figure 15:
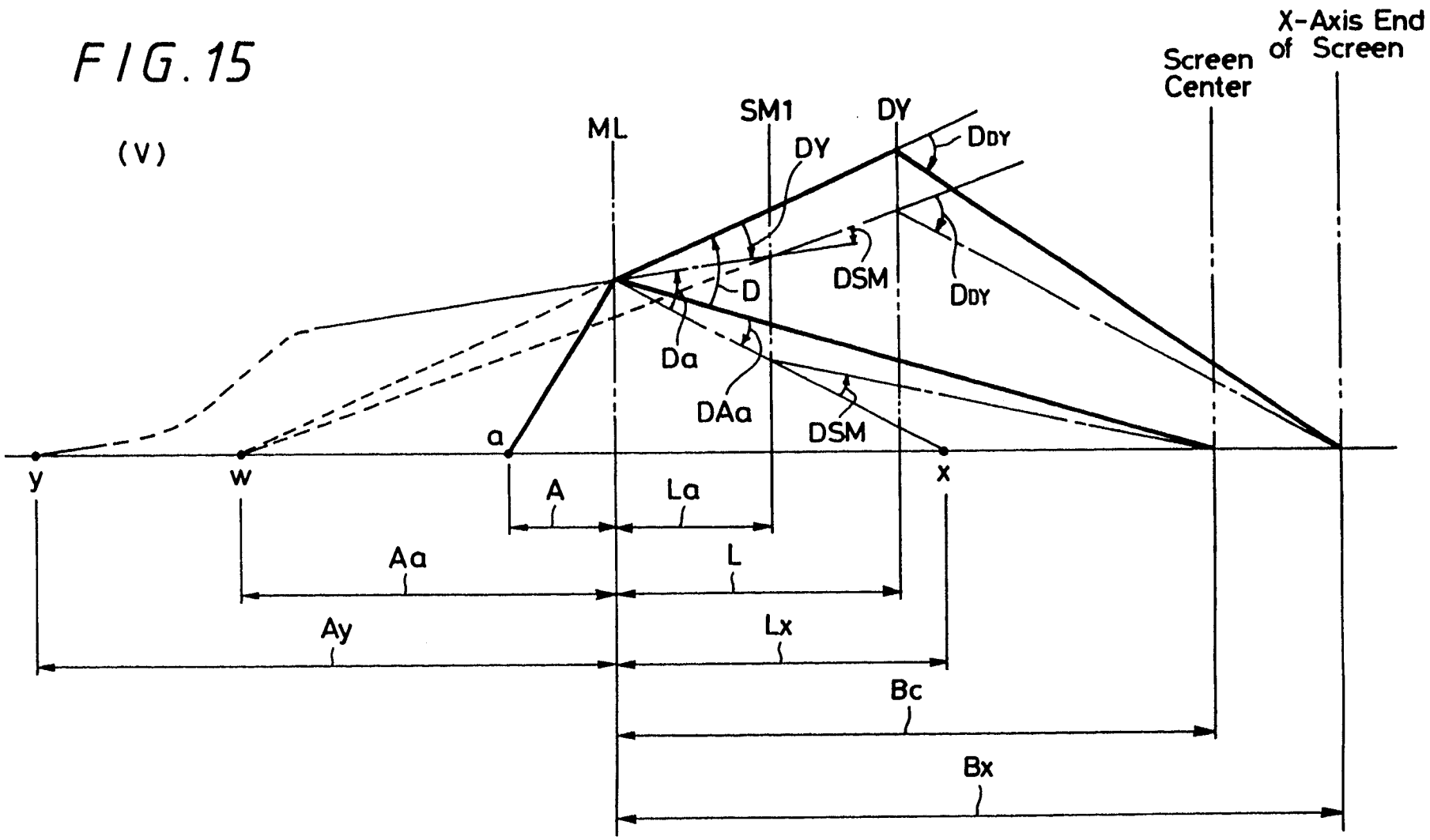
FIG. 15 is a diagram illustrative of the action of the first quadruple convergence yoke lens system, shown with respect to electron beam trajectories and lens diopters.

The manner in which the dynamic corrective voltage is reduced by the first quadruple convergence yoke lens system SM1 will be described below with reference to FIG. 15. In FIG. 15, a point x represents a hypothetical focus point produced by the first quadruple convergence yoke lens system SM1 in the direction of the screen center, a point y represents a hypothetical object point produced by the first quadruple convergence yoke lens system SM1 in the direction of the X-axis end, and a point w represents a hypothetical object point produced in the direction of the X-axis end if the first quadruple convergence yoke lens system SM1 were not provided.

With the first quadruple convergence yoke lens system SM1 provided, the electron beam travels from the main lens ML to the screen center and also from the main lens ML to the X-axis end along trajectories indicated by the dot-and-dash lines. With the first quadruple convergence yoke lens system SM1 not provided, the electron beam travels from the main lens ML to the screen center and also from the main lens ML to the X-axis end along trajectories indicated by the thick solid lines.

The main lens ML has a lens diopter D if the first quadruple convergence yoke lens system SM1 is not provided. The main lens ML has a lens diopter Da if the first quadruple convergence yoke lens system SM1 is provided. The first quadruple convergence yoke lens system SM1 has a lens diopter $D_{SM}$, and the deflection yoke DY has a lens diopter $D_{DY}$.

To reduce the dynamic corrective voltage, the lens diopters D, Da should meet the relationship: D>Da, and hence lens diopters DA, DAa indicated by the following equations should meet the relationship: DA>DAa:

$$DA = \frac{1}{A_a} - \frac{1}{A_y} \tag{1}$$

$$DA_a = \frac{1}{L_x} - \frac{1}{B_c}$$

The letters and numerals in the equations are all positive.

The lens diopter $D_{SM}$ of first quadruple convergence yoke lens system SM1 is given by the following equations:

$$D_{SM} = \frac{1}{A_a + L_a} - \frac{1}{A_y + L_a} \tag{2}$$

$$\left[ D_{DY} = \frac{1}{A_a + L} + \frac{1}{B_x - L} \right]$$

$$D_{SM} = \frac{1}{L_x - L_a} - \frac{1}{B_c - L_a}$$

Therefore, the lens diopters DA and DAa can be replaced with the following equations:

$$DA = \frac{D_{SM}(L_a + A_a)^2}{A_a^2 + D_{SM}L_aA_a(A_a + L_a)} \tag{3}$$

$$DA_a = \frac{D_{SM}(B_c - L_a)^2}{B_c^2 + D_{SM}L_aB_c(B_c - L_a)}$$

If La<Bc, La<Aa (La≈Bc/5 in the actual system), then the term of $La^2$ is negligible, and hence the above equations (3) may be approximated by the following equations:

$$DA \approx \frac{D_{SM}}{(1 + D_{SM}L_a)} \cdot \left(1 + \frac{2L_a}{A_a}\right) \tag{4}$$

$$DA_a \approx \frac{D_{SM}}{(1 + D_{SM}L_a)} \cdot \left(1 - \frac{2L_a}{B_c}\right)$$

From the equations (4), the relationship $DA > DA_a$ is satisfied. If La=0 (with the first quadruple lens on the main lens), then DA=DAa.

It follows from the above that a corrective quantity which needs to be introduced on the main lens ML for correcting a shift of the focus point due to the first quadruple convergence yoke lens system SM1 (having the fixed astigmatism $D_{SM}$) disposed between the main lens ML and the deflection yoke DY is such that the lens diopter DA on the side of the X-axis end is greater than the lens diopter DAa (both lens diopters are of convex lens nature). Therefore, the difference (dynamic corrective quantity) between the screen center and the X-axis end of the screen is reduced by the fixed astigmatism $D_{SM}$ between the main lens ML and the deflection yoke DY, and hence the dynamic corrective voltage applied is reduced.

One problem which remains to be solved here is that the electron beam spot is vertically elongate at the screen center as shown in FIG. 14A. The electron beam spot is vertically elongate at the screen center because a vertical image magnification $M_v$ ($=b_v/a_v$) and a horizontal image magnification $M_H$ ($=b_H/a_H$) are caused to differ from each other by the quadruple lens Qp1 as shown in FIG. 13. The vertically elongate shape of the electron beam spot can also be appreciated from the fact that the center LV of a vertical composite lens and the center LH of a horizontal composite lens are different from each other.

According to the present invention, the second quadruple convergence yoke lens system SM2 is provided between the cathode assembly K and the main lens region 5.

Figure 16:
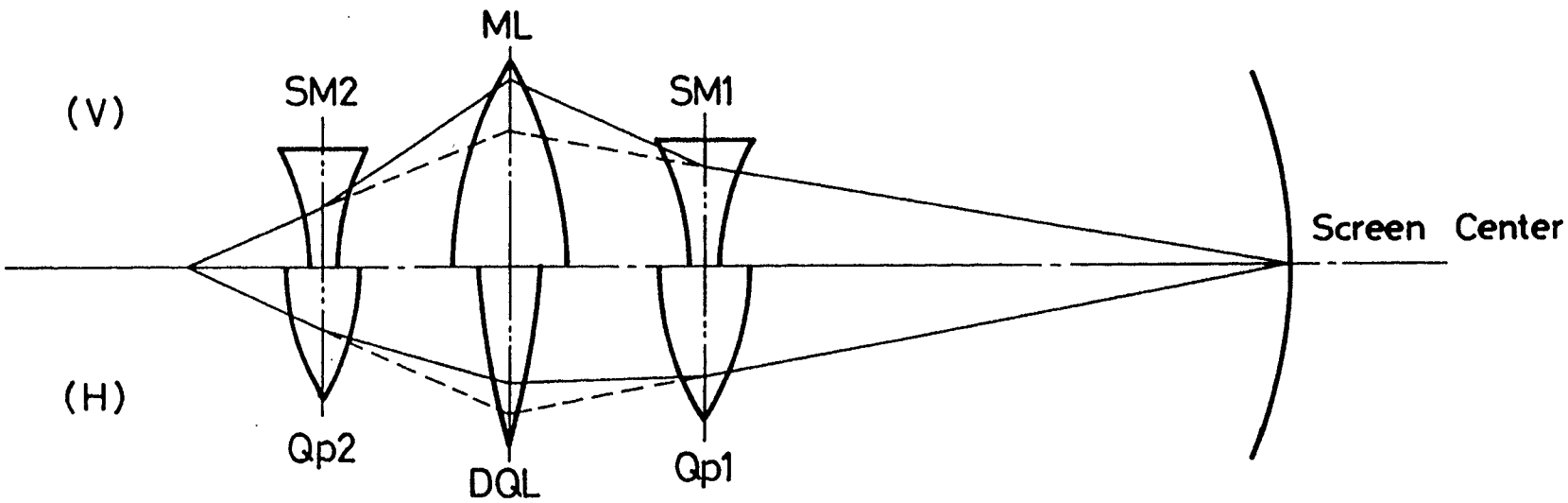
FIG. 16 is a diagram illustrative of the action of the first and second quadruple convergence yoke lens systems.

The cathode-ray tube with the first and second quadruple convergence yoke lens systems SM1, SM2 will be described below using an optical lens system which simulates the electron gun. As shown in FIG. 16, the second quadruple convergence yoke lens system SM2 is represented by a combination of a concave lens in the vertical direction and a convex lens in the horizontal direction, which are positioned between the cathode assembly K and the main lens ML. These concave and convex lenses jointly provide a quadruple lens Qp2 which diverges the electron beams vertically and converges the electron beams horizontally.

As with the quadruple lens Qp1, the quadruple lens Qp2 is of fixed astigmatism and has an astigmatic effect that is opposite to the astigmatic effect of the main lens ML. In FIG. 16, the main lens ML and the first quadruple convergence yoke lens system SM1 have an astigmatic effect described above with reference to FIG. 13.

Figure 17B:
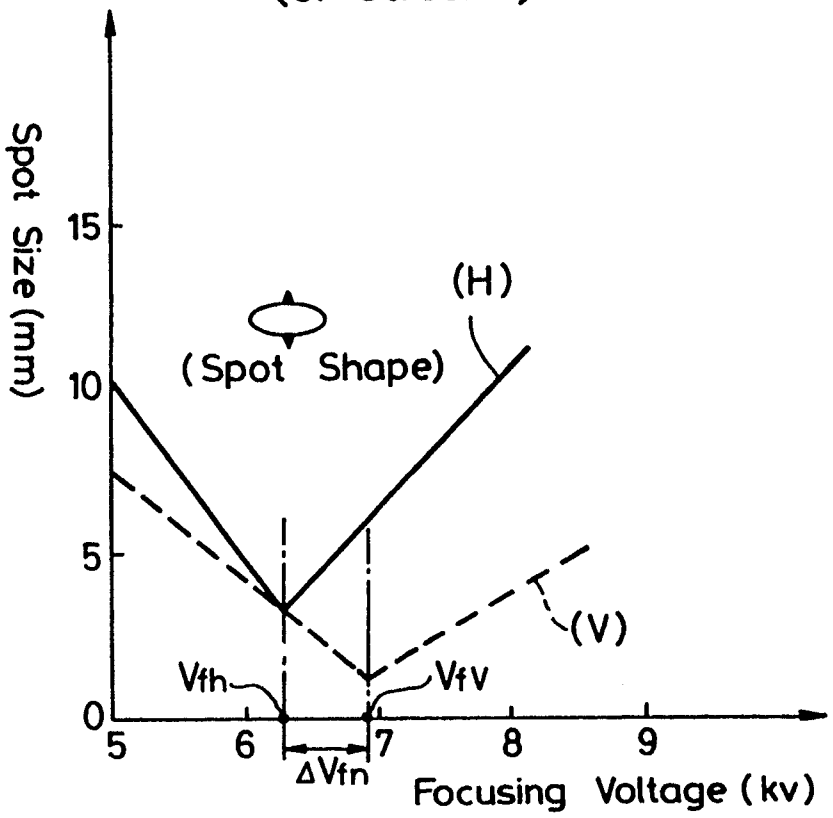
FIGS. 17A and 17B are diagrams showing the relationship between spot sizes and focusing voltages at the center and the X-axis end, respectively, of the phosphor screen, achieved through the action of the first and second quadruple convergence yoke lens systems.
Figure 17A:
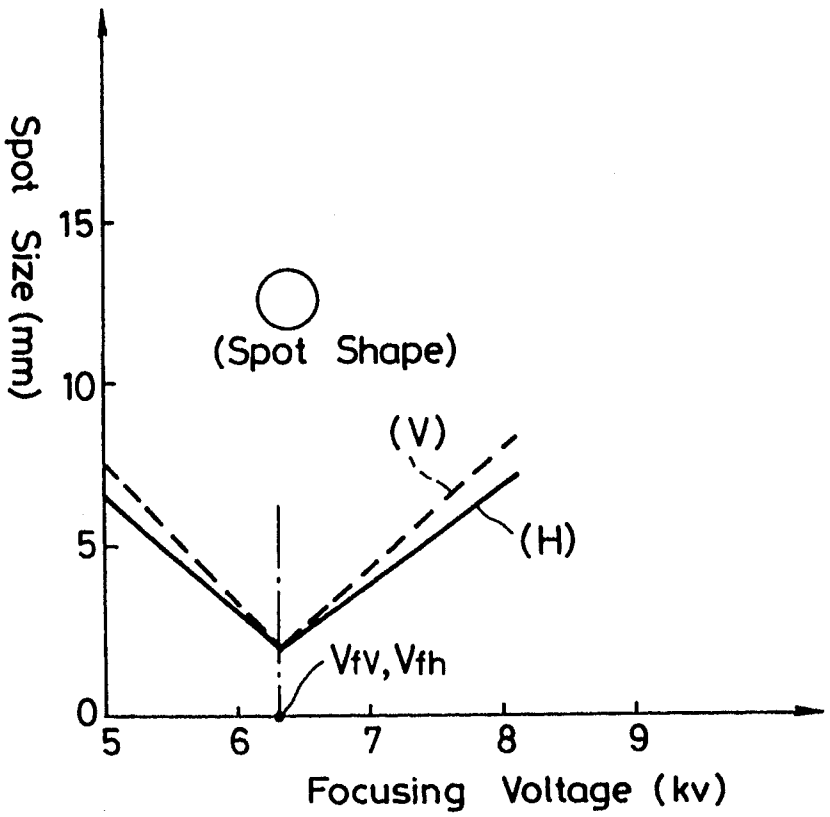

As shown in FIGS. 17A and 17B, focusing voltages Vfv, Vfh applied to bring each of the electron beam spots into focus vertically and horizontally at the center of the phosphor screen are equal to each other. Therefore, the electron beams can be brought into exact focus vertically and horizontally at the center of the phosphor screen by the first and second quadruple convergence yoke lens systems SM1, SM2. The minimum sizes of the electron beam spot in the vertical and horizontal directions are equal to each other, resulting in a circular spot shape at the screen center. An astigmatic difference Δfn at the X-axis end of the screen is almost the same as the astigmatic difference Δfm shown in FIG. 14B, and hence is smaller than the conventional astigmatic difference Δfo.

It will be understood from FIGS. 14A, 14B, 17A, and 17B that a dynamic corrective voltage ΔVf proportional to the dynamic focusing corrective quantity is reduced by the first quadruple convergence yoke lens system SM1 and remains reduced even with the addition of the second quadruple convergence yoke lens system SM2 ($\Delta Vfn = \Delta Vfm < \Delta Vfo$).

Stated otherwise, the difference ΔVf between the focusing voltages in the respective vertical and horizontal directions due to the astigmatism at the X-axis end of the screen depends only on the first quadruple convergence yoke lens system SM1, i.e., the intensity and position of the astigmatism), and is determined essentially irrespective of the additional second quadruple convergence yoke lens system SM2.

Figure 18:
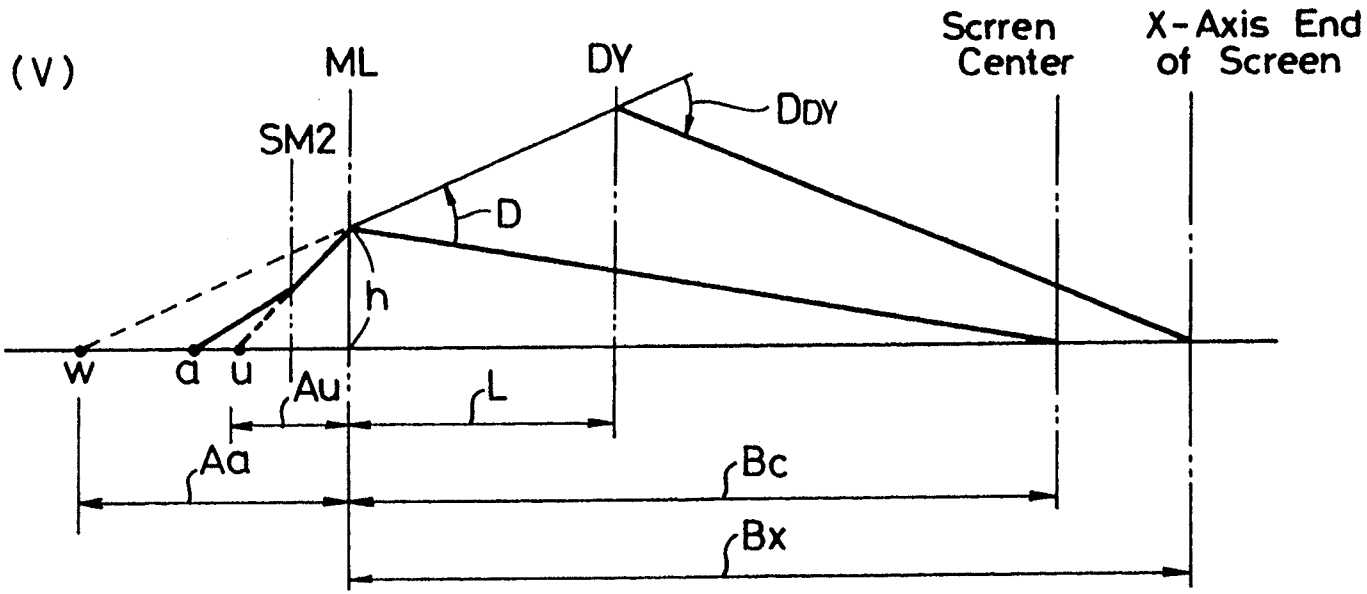
FIG. 18 is a diagram illustrative of the action of the second quadruple convergence yoke lens system, shown with respect to electron beam trajectories and lens diopters.

The action of the second quadruple convergence yoke lens system SM2 will be described below with reference to FIG. 18. In FIG. 18, the main lens ML has a lens diopter D, and the deflection yoke DY has a lens diopter $D_{DY}$. A point u represents a hypothetical object point for the second quadruple convergence yoke lens system SM2 in the direction of the screen center. Other reference characters shown in FIG. 18 which are identical to those shown in FIG. 15 denote identical quantities.

The lens diopter $D_{DY}$ is represented by the following equation:

$$D_{DY} = \frac{1}{B_x - L} + \frac{1}{A_a + L} = \text{constant} \tag{5}$$

where Bx, Aa, and L are fixed values that are determined when the cathode-ray tube is designed. Therefore, the lens diopter $D_{DY}$ is constant.

Similarly, the lens diopter D is given as follows:

$$D = -\left(\frac{1}{A_a} + \frac{1}{B_c}\right) = \text{constant} \tag{6}$$

where Bc is also a fixed value that is determined when the cathode-ray tube is designed. Therefore, the lens diopter D is constant, and does not depend on the height h of an entrance point where the electron beam is applied to the main lens ML and the distance Au from the main lens ML to the hypothetical object point u for the second quadruple convergence yoke lens system SM2.

Thus, a corrective quantity required for the main lens ML depends only on the conditions of the elements on the side of the main lens ML toward the deflection yoke DY, and is determined irrespective of the conditions of the elements on the side of the main lens ML toward the cathode assembly K. With the addition of the second quadruple convergence yoke lens system SM2, a reduction in the dynamic focusing voltage can be achieved while maintaining the circular electron beam spot at the screen center.

Since the concave lenses are added in the vertical direction and the convex lenses are added in the horizontal direction in front of and behind the main lens ML, the focal planes at the screen center would differ from each other in the vertical and horizontal directions. To compensate for such a difference, it is necessary for the main lens ML to have different lens power intensities in the vertical and horizontal directions, i.e., to have a stronger focusing effect in the vertical direction. Such different lens power intensities may be achieved if the main lens ML has its aperture rotationally asymmetric in shape. In the illustrated embodiment, the different lens power intensities are achieved by the built-in quadruple convergent yoke structure in the main lens region 5.

With the arrangement of the present invention, the first quadruple convergence yoke lens system SM1, which generates an astigmatic effect on the electron beam which is opposite to the astigmatism due to the deflection magnetic field, is disposed between the main lens region 5 and the deflection yoke DY for making the ratio $M_V/M_H$ of the vertical and horizontal image magnifications $M_V$, $M_H$ greater than 1, thus reducing the difference (astigmatic difference) ΔVf between the dynamic focusing voltages applied to the main lens region 5.

The second quadruple convergence yoke lens system SM2, which produces an astigmatic effect in the same direction as the astigmatic effect produced by the first quadruple convergence yoke lens system SM1, is disposed between the cathode assembly K and the main lens region 5. While the difference ΔVf between the dynamic focusing voltages applied to the main lens region 5 remains reduced, the second quadruple convergence yoke lens system SM2 is effective to cause the magnification ratio $M_V/M_H$ to approach 1, thereby applying a substantially circular electron beam spot to the center of the phosphor screen.

Accordingly, the cathode-ray tube according to the present invention can reduce the astigmatic difference ΔVf, or the difference between the focusing voltages between the vertical and horizontal directions, at the peripheral region of the phosphor screen, without varying the shape of the electron beam spot at the center of the phosphor screen. Therefore, the dynamic corrective quantity can be reduced, and any burden on the circuit arrangement used to generate and apply the corrective voltages can also be reduced.

The first quadruple convergence yoke lens system SM1 may be in the form of a sheet-like or ring-shaped magnet disposed around the neck 1 of the cathode-ray tube. However, though such a sheet-like or ring-shaped magnet can produce an astigmatic effect in a position closer to the deflection yoke DY, it does not do so equally on the three electron beams R, G, B.

In the embodiment shown in FIG. 6A–6C, as described above, the first quadruple convergence yoke lens system SM1 is composed of three flat metallic circular plates, i.e., the first, second, and third electrodes 10A, 10B, 10C, disposed between the fifth grid $G_5$ and the electrostatic deflection plates 2 and lying perpendicularly to the axis of the cathode-ray tube. Each of the first and third electrodes 10A, 10C has a single horizontally elongate rectangular beam passage hole 11 for passage therethrough of the electron beams R, G, B emitted from the cathode assembly K, and the second electrode 10B, disposed between the first and second electrodes 10A, 10C, has three separate vertically elongate rectangular beam passage holes 12R, 12G, 12B for passage therethrough of the respective electron beams R, G, B emitted from the cathode assembly K. The anode voltage Hv is applied to the first and third electrodes 10A, 10C, whereas the convergence voltage Hc is applied to the second electrode 10B. Accordingly, the astigmatic effect is equally applied to the three electron beams R, G, B. The astigmatic effect is uniform and stable as it is generated electrostatically by the first quadruple convergence yoke lens system SM1.

A cathode-ray tube according to still another embodiment of the present invention will be described below with reference to FIGS. 19 and 20A through 20D.

Figure 19:
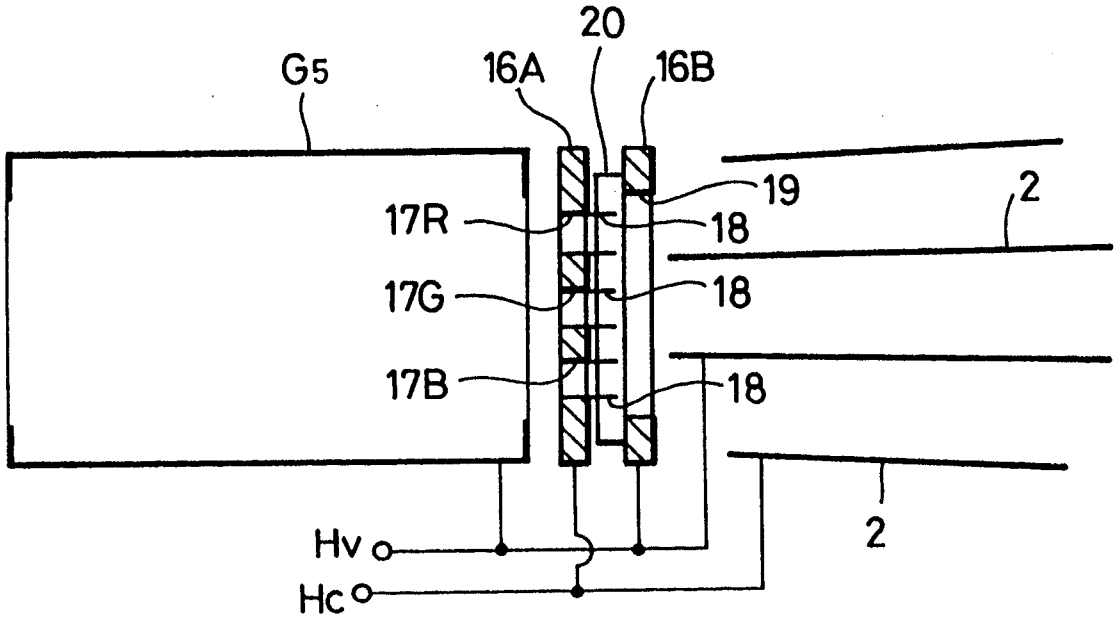
FIG. 19 is a fragmentary horizontal cross-sectional view of a first quadruple convergence yoke lens system, as viewed from above, in a cathode-ray tube according to still another embodiment of the present invention.
Figure 20A:
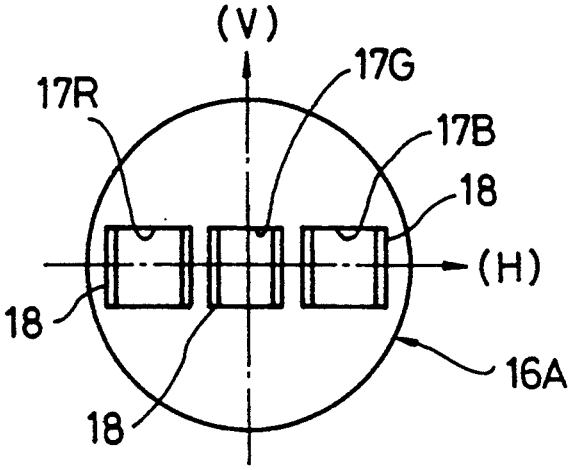
FIG. 20A is a front elevational view of a first electrode, as viewed from the phosphor screen, of the first quadruple convergence yoke lens system shown in FIG. 19.
Figure 20B:
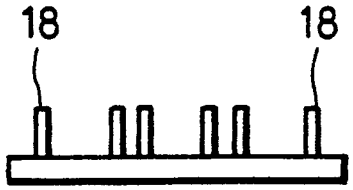
FIG. 20B is a plan view of the first electrode shown in FIG. 20A.
Figure 20C:
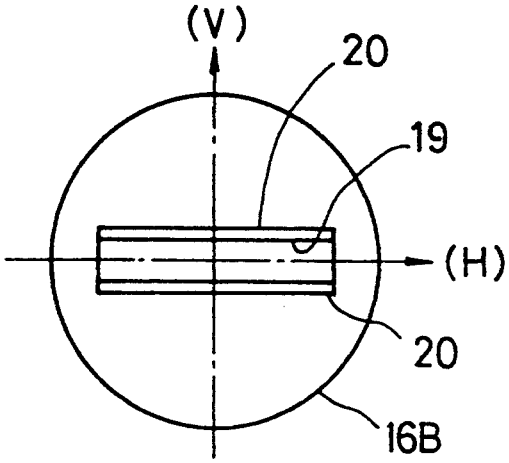
FIG. 20C is a front elevational view of a second electrode, as viewed from the cathode, of the first quadruple convergence yoke lens system shown in FIG. 19.
Figure 20D:
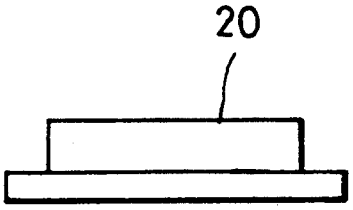
FIG. 20D is a plan view of the second electrode shown in FIG. 20C.

As shown in FIG. 19, the cathode-ray tube includes a first quadruple convergence yoke lens system SM1 disposed between a fifth grid $G_5$ and an assembly of electrostatic deflection plates 2. The first quadruple convergence yoke lens system SM1 comprises first and second electrodes 16A, 16B in the form of flat metallic discs lying perpendicularly to the axis of the cathode-ray tube.

The first electrode 16A, which is located closer to the fifth grid $G_5$, has three separate beam passage holes 17R, 17G, 17B defined therein for passage therethrough of the electron beams R, G, B. The beam passage holes 17R, 17G, 17B are successively arranged in the horizontal direction and are vertically elongate and rectangular in shape with their longer axes extending vertically. The first electrode 16A also has a total of six flanges 18 extending at a right angle from respective vertical side edges of the beam passage holes 17R, 17G, 17B toward the second electrode 16B. The flanges 18 may be raised from the first electrode 16A or welded to the first electrode 16A.

The second electrode 16B, which is located closer to the electrostatic deflection plates 2, has a single beam passage hole 19 defined therein for passage therethrough of all the electron beams R, G, B. The beam passage hole 19 is horizontally elongate and rectangular in shape with its longer axis extending horizontally. The second electrode 16B also has a pair of flanges 20 extending at a right angle from respective horizontal upper and lower edges of the beam passage hole 19 toward the first electrode 16A. The flange 20 may be raised from the second electrode 16B or welded to the second electrode 16B.

The first and second electrodes 16A, 16B are arranged such that the flanges 18 and the flanges 20 are disposed in confronting relationship to each other. The convergence voltage Hc is applied to the first electrode 16A, whereas the anode voltage Hv is applied to the second electrode 16B.

The first quadruple convergence yoke lens system SM1 shown in FIGS. 19 and 20A through 20D is also effective in applying an astigmatic effect equally to the three electron beams R, G, B. The astigmatic effect thus applied is uniform and stable as it is generated electrostatically by the first quadruple convergence yoke lens system SM1.

Figure 21A:
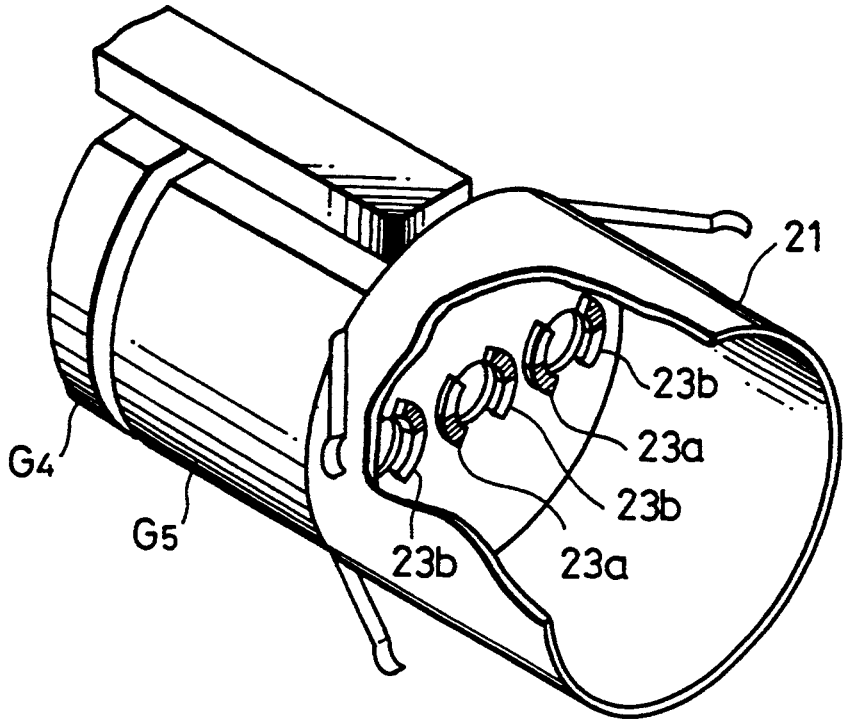
FIG. 21A is a perspective view, partly cut away, of a first quadruple convergence yoke lens system according to yet another embodiment of the present invention.
Figure 21B:
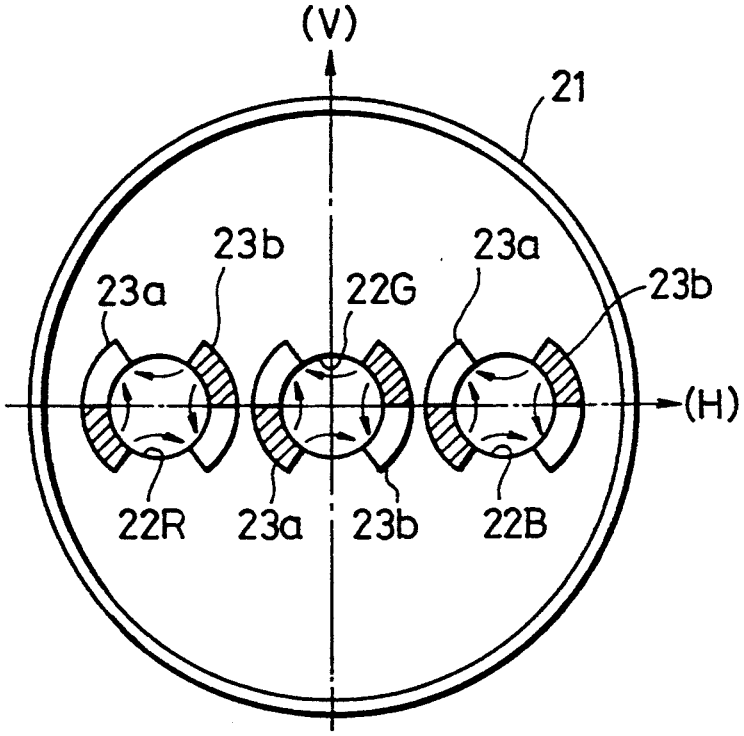
FIG. 21B is a front elevational view of the first quadruple convergence yoke lens system, as viewed from the phosphor screen, shown in FIG. 21A.

FIGS. 21A and 21B show a first quadruple convergence yoke lens system according to yet another embodiment of the present invention. The first quadruple convergence yoke lens system shown in FIGS. 21A and 21B magnetically generates an astigmatic effect on the electron beams.

In FIGS. 21A and 21B, the first quadruple convergence yoke lens system is incorporated in a three-gun three-beam cathode-ray tube. The first quadruple convergence yoke lens system has two diametrically opposite sheet-like magnets **23*a*, 23*b* attached to peripheral edges of each of circular beam passage holes 22R, 22G, 22B defined in the bottom of a convergence cup 21. The sheet-like magnets 23*a*, 23*b* disposed around each of the beam passage holes 22R, 22G, 22B are arranged such that, if the plane in which they are disposed is divided into four quadrants, they have N-poles (shown hatched) in the first and third quadrants and S-poles in the second and fourth quadrants. Therefore, the sheet-like magnets 23*a*, 23*b*** produce a magnetic field in a direction indicated by the arrows.

Figure 22A:
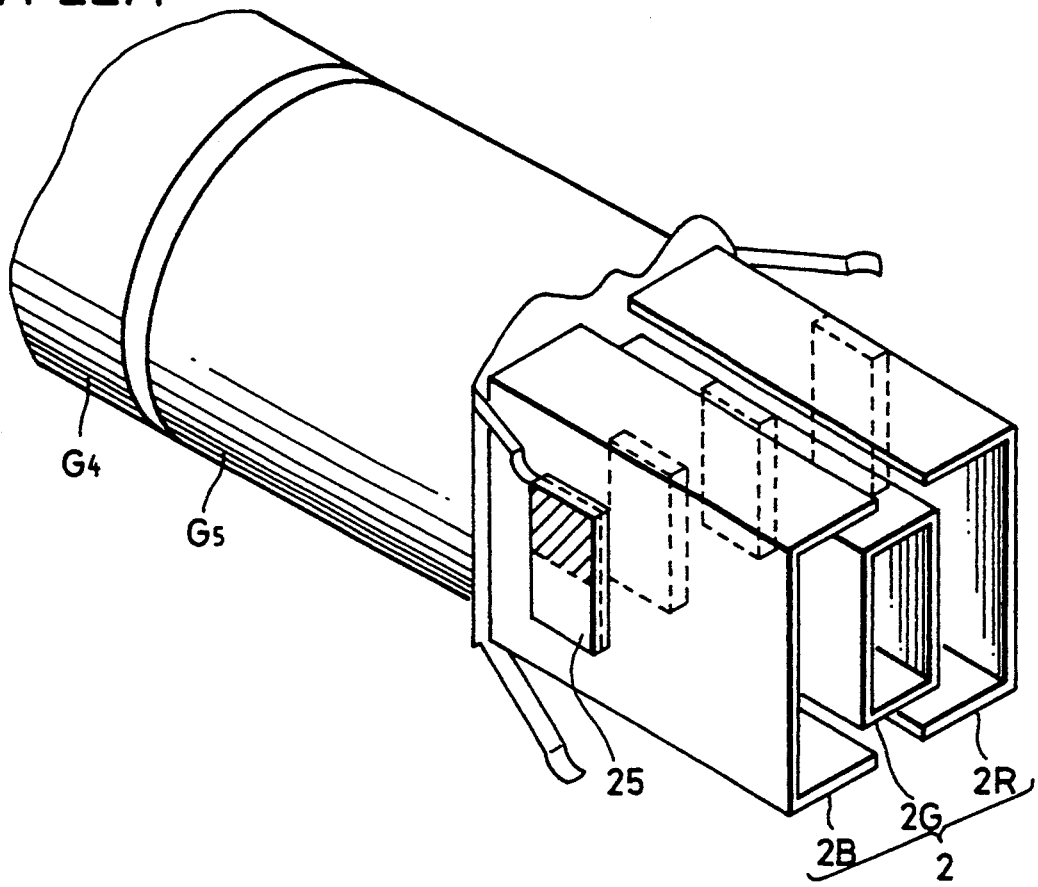
FIG. 22A is a perspective view, partly cut away, of a first quadruple convergence yoke lens system according to a further embodiment of the present invention.
Figure 22B:
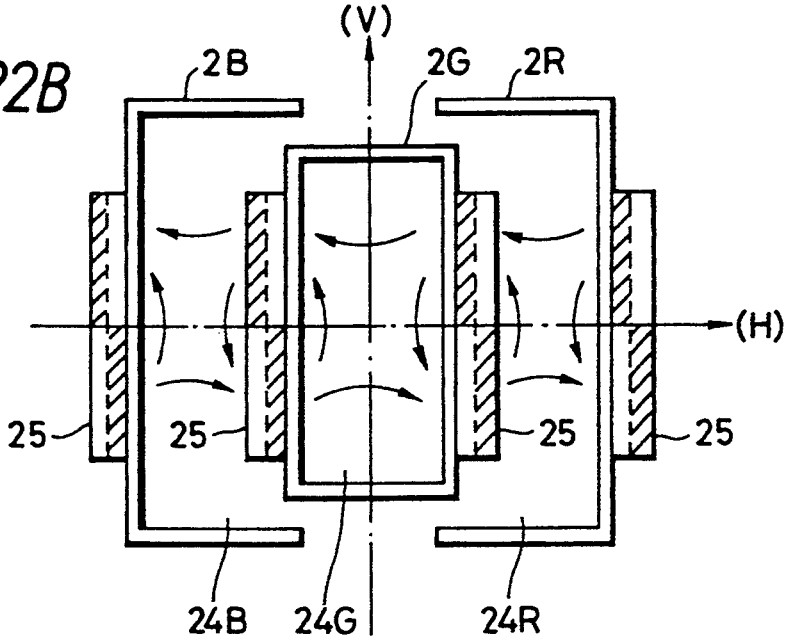
FIG. 22B is a front elevational view of the first quadruple convergence yoke lens system, as viewed from the phosphor screen, shown in FIG. 22A.

FIGS. 22A and 22B show a first quadruple convergence yoke lens system according to a further embodiment of the present invention. The first quadruple convergence yoke lens system shown in FIGS. 22A and 22B magnetically generates an astigmatic effect on the electron beams.

In FIGS. 22A and 22B, the first quadruple convergence yoke lens system is incorporated in a one-gun three-beam cathode-ray tube. The first quadruple convergence yoke lens system has a thin rectangular sheet-like magnet 25 attached to each of side walls of the electrostatic deflection plates 2, which define beam passage holes 24R, 24G, 24B, near the fifth grid $G_5$. More specifically, as shown in FIGS. 22A and 22B, the electrostatic deflection plates 2 include first, second, third deflection plates 2B, 2G, 2R, the first and third deflection plates 2B, 2R being of a channel-shaped cross section and the second deflection plate 2G being of a rectangular cross section. As viewed from the phosphor screen in FIG. 22B, one sheet-like magnet 25 is attached to an outer lefthand vertical surface of the first deflection plate 2B, two sheet-like magnets 25 are attached to respective opposite outer vertical surfaces of the second deflection plate 2G, and one sheet-like magnet 25 is attached to an outer righthand vertical surface of the third deflection plate 2R. Each of the sheet-like magnets 25 have N-poles (shown hatched) in its upper lefthand and lower righthand portions, and S-poles in its upper righthand and lower lefthand portions.

In each of the embodiments shown in FIGS. 21A, 21B, 22A, and 22B, the first quadruple convergence yoke lens system is effective to exert an astigmatic effect equally on the electron beams R, G, B. Though the electron beams R, G, B which are subjected to the magnetic astigmatic action by the sheet-like magnets 25 are partly affected by the deflection magnetic field produced by the deflection yoke DY, any influence on the convergence is very small and no practical problem occurs as the astigmatic effect is equally applied to the three electron beams R, G, B.

Having described preferred embodiments of the invention with reference to the accompanying drawings, it is to be understood that the invention is not limited to that precise embodiments and that various changes and modifications could be effected by one skilled in the art without departing from the spirit or scope of the invention as defined in the appended claim.

What is claimed is:

1. A cathode-ray tube comprising:

a phosphor screen;

a deflection yoke; and an electron gun disposed in confronting relationship to said phosphor screen, electrons from said electron gun passing through said deflection yoke, said electron gun comprising:

emitting means for emitting three electron beams;

main lens means for passing said three electron beams therethrough, said main lens means including a quadruple lens system responsive to focusing voltages for canceling an undesired astigmatic effect produced on said three electron beams at a peripheral region of said phosphor screen when said three electron beams are deflected by said deflection yoke;

a first quadruple convergence yoke lens system disposed between said main lens means and said deflection yoke for generating a first correcting astigmatic effect opposite to said undesired astigmatic effect produced on said three electron beams when said three electron beams are deflected, said first quadruple convergence yoke lens system comprising first, second and third flat electrodes arranged substantially perpendicularly to an axis of the cathode-ray tube, said first electrode being positioned closer to said main lens means, said third electrode being positioned closer to said phosphor screen, each of said first and third electrodes having an elongate rectangular beam passage hole defined therein for passing said electron beams therethrough, said second electrode being positioned between said first and third electrodes and having three separate elongate rectangular beam passage holes defined therein for passing said electron beams respectively therethrough; and a second quadruple convergence yoke lens system disposed between said emitting means and said main lens means for generating a second correcting astigmatic effect in the same direction as said first correcting astigmatic effect generated by said first quadruple convergence yoke lens system, said second quadruple convergence yoke lens system comprising an electrode arranged substantially perpendicularly to an axis of the cathode-ray tube, said electrode having a plurality of successive beam passage holes defined therein for passing the electron beams respectively therethrough.

2. A cathode-ray tube according to claim 1, wherein each of said first and second quadruple convergence yoke lens systems comprises concave lens means in a direction normal to and convex lens means in a direction parallel to a direction in which the electron beams are deflected by said deflection yoke.

3. A cathode-ray tube according to claim 1 or 2, wherein said quadruple lens system of said main lens means comprises convex lens means in a first direction normal to and convex lens means in a second direction parallel to a direction in which the electron beams are deflected by said deflection yoke, each of said convex lens means having a stronger lens power intensity in said first direction and a weaker lens power intensity in said second direction.

4. A cathode-ray tube comprising:

a phosphor screen;

a deflection yoke; and an electron gun disposed in confronting relationship to said phosphor screen, electrons from said electron gun passing through said deflection yoke, said electron gun comprising:

emitting means for emitting three electron beams;

main lens means for passing said three electron beams therethrough, said main lens means including a quadruple lens system responsive to focusing voltages for canceling an undesired astigmatic effect produced on said three electron beams at a peripheral region of said phosphor screen when said three electron beams are deflected by said deflection yoke;

a first quadruple convergence yoke lens system disposed between said main lens means and said deflection yoke for generating a first correcting astigmatic effect opposite to said undesired astigmatic effect produced on said three electron beams when said three electron beams are deflected; and a second quadruple convergence yoke lens system disposed between said emitting means and said main lens means for generating a second correcting astigmatic effect in the same direction as said first correcting astigmatic effect generated by said first quadruple convergence yoke lens system, wherein said first quadruple convergence yoke lens system comprises a convergence cup having three separate beam passage holes defined therein for passing said electron beams respectively therethrough, and three pairs of flat magnets, said flat magnets in each pair being disposed on opposite edges of one of said beam passage holes.

5. A cathode-ray tube comprising:

a phosphor screen;

a deflection yoke; and an electron gun disposed in confronting relationship to said phosphor screen, electrons from said electron gun passing through said deflection yoke, said electron gun comprising:

emitting means for emitting three electron beams;

main lens means for passing said three electron beams therethrough, said main lens means including a quadruple lens system responsive to focusing voltages for canceling an undesired astigmatic effect produced on said three electron beams at a peripheral region of said phosphor screen when said three electron beams are deflected by said deflection yoke;

a first quadruple converge yoke lens system disposed between said main lens means and said deflection yoke for generating a first correcting astigmatic effect opposite to said undesired astigmatic effect produced on said three electron beams when said three electron beams are deflected; and a second quadruple convergence yoke lens system disposed between said emitting means and said main lens means for generating a second correcting astigmatic effect in the same direction as said first correcting astigmatic effect generated by said first quadruple convergence yoke lens system, wherein said first quadruple convergence yoke lens system comprises a plurality of side walls defining electron beam passages therebetween for passing said electron beams respectively therethrough, and a plurality of flat magnets mounted on said side walls, respectively.

* * * * *